US005337557A

United States Patent [19]

Toyoda

[11] Patent Number: 5,337,557

[45] Date of Patent: Aug. 16, 1994

[54] AIR-FUEL RATIO CONTROL DEVICE FOR INTERNAL COMBUSTION ENGINE

[75] Inventor: Katsuhiko Toyoda, Shizuoka, Japan

[73] Assignee: Suzuki Motor Corporation, Shizuoka, Japan

[21] Appl. No.: 21,332

[22] Filed: Feb. 23, 1993

[30] Foreign Application Priority Data

| | | | |
|---|---|---|---|
| Feb. 29, 1992 | [JP] | Japan | 4-078900 |
| Feb. 29, 1992 | [JP] | Japan | 4-078901 |
| Feb. 29, 1992 | [JP] | Japan | 4-078906 |
| Feb. 29, 1992 | [JP] | Japan | 4-078907 |

[51] Int. Cl.[5] ..... F01N 3/20

[52] U.S. Cl. ..... 60/276; 123/674; 60/285

[58] Field of Search ..... 60/276, 277, 285; 123/674

[56] References Cited

U.S. PATENT DOCUMENTS

| | | | |
|---|---|---|---|
| 4,693,076 | 9/1987 | Chujo et al. . | |
| 4,707,984 | 11/1987 | Katsuno et al. . | |
| 4,720,973 | 1/1988 | Katsuno | 60/285 |
| 4,831,838 | 5/1989 | Nagai | 60/276 |
| 4,854,124 | 8/1989 | Tamura | 60/276 |
| 4,977,881 | 12/1990 | Abe | 423/674 |
| 5,154,054 | 10/1992 | Nakane | 60/277 |
| 5,154,055 | 10/1992 | Nakane | 60/277 |
| 5,157,921 | 10/1992 | Ito | 60/277 |
| 5,168,700 | 12/1922 | Furuya | 123/688 |
| 5,168,701 | 12/1992 | Yamamoto | 123/674 |
| 5,193,339 | 3/1993 | Furuya | 60/276 |
| 5,220,788 | 6/1993 | Korita | 60/276 |

FOREIGN PATENT DOCUMENTS

| | | | |
|---|---|---|---|
| 61-234241 | 10/1986 | Japan . | |
| 61-237858 | 10/1986 | Japan . | |
| 3253714 | 11/1991 | Japan | 60/276 |
| 4008854 | 1/1992 | Japan | 60/276 |

*Primary Examiner*—Carl S. Miller

*Attorney, Agent, or Firm*—Flynn, Thiel, Boutell & Tanis

[57] ABSTRACT

An air-fuel ratio control device for an internal combustion engine, in which a first exhaust sensor is disposed at an exhaust passage of an internal combustion engine on an upstream side of a catalytic member which is disposed at the exhaust passage, and a second exhaust sensor is disposed at the exhaust passage on a downstream side of the catalytic member, with the air-fuel ratio being feedback-controlled by a control system in accordance with detection signals from the front and rear exhaust sensors.

4 Claims, 30 Drawing Sheets 2
4
6
8
10
12
14
16
18
20
22
24
26
28
30
32
34
36
38
40
42
44
46
48
50
52
54
56
58
60
62
68
70
72
74
76
78
82
84
86
88
90
92
94
96
98
100
102
104
106

IRL : SECOND FEEDBACK CONTROL INTEGRAL VALUE

SRL, SLR : SECOND FEEDBACK CONTROL SKIP VALUE $$SOXFLAV = \left( \sum_{i=1}^{\chi-1} SOXFBAVi + SOXFBAV\chi \right) / \chi$$

BLOWBY EVAPO-GAS
AIR
EXHAUST GAS
ECM
114
120
122
118
128
126
124
132
130
96
28
94
98
84
86
82
104
102
106
68
100
116
42
44
40
90
18-3
16
112
110
108
8
4
38
36
34
32
2
22
20
6
56
58
92
10
26
24
18-1
12
70
28
72
14
46
88
18-2
76
78
66
80
30
74
60
52
62
64
54
50
48

REAR FEEDBACK INTEGRAL VALUE $I_{RL}$ IS CHANGED AT EVERY PREDETERMINED TIME ($T_K$) PASSAGE $I_{RL}$: REAR $O_2$ INTEGRAL VALUE $S_{RL}$, $S_{LR}$: REAR $O_2$ SKIP VALUE

RICH/LEAN REVERSE DELAY ($D_{LR}$ / $D_{RL}$) TIME OF FRONT FEEDBACK VALUE IS CHANGED DEPENDING ON SOXFB (%).

DETERIORATION OF CATALYST

DETERMINATION $T_K = T_K \times (\alpha_1 + \alpha_2 + \alpha_3)/3$ $\parallel$ $T_K'$ $T_K$ : BASE $T_K'$ : AFTER-CORRECTION $t_K$

FIG. 43

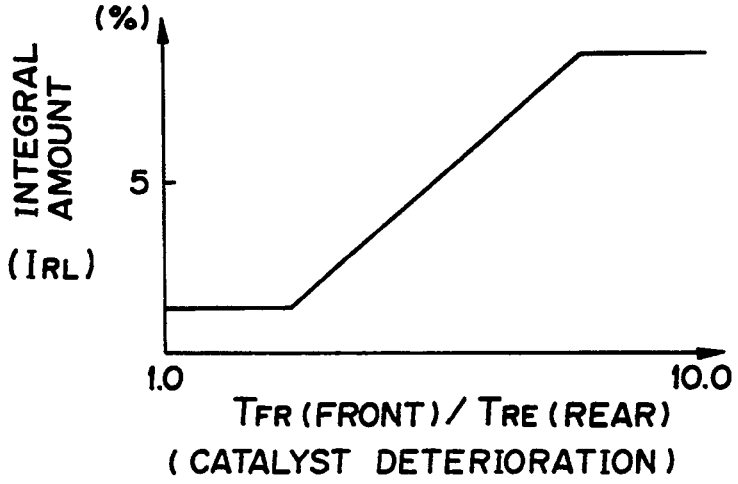

FIG. 44

REAR $O_2$ FEEDBACK LEARNING CONTROL

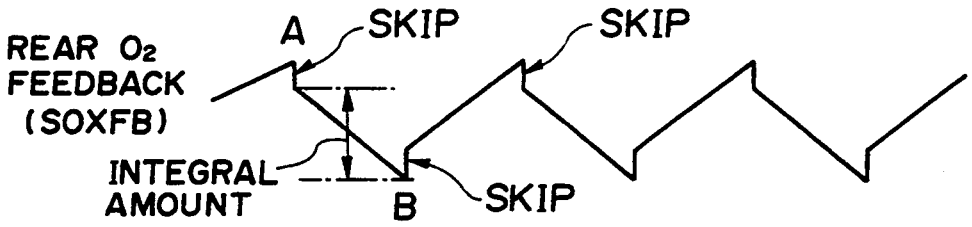

AVERAGE BETWEEN VALUE (B) IMMEDIATELY BEFORE SKIP AT THIS TIME AND VALUE (A) IMMEDIATELY BEFORE SKIP AT PRECEDING TIME IS FOUND AT EVERYSKIP OF SOXFB.

(SOXFBAV)

$$SOXFBAV = \frac{A+B}{2}$$

FEEDBACK CONTROLLING SOXFLAV OF RICH/LEAN REVERSE DELAY TIME ($D_{RL} \cdot D_{LR}$) OF FRONT $O_2$ FEEDBACK IS FOUND FROM SOXFBAV IN ACCORDANCE WITH THE FOLLOWING EXPRESSION (FIGS. 36 AND 37)

$$SOXFLAV = \left( \sum_{i=1}^{x-1} SOXFBAVi + SOXFBAVx \right) / x \quad \text{----(1)}$$

( REAR $O_2$ FEEDBACK LEARNED VALUE )

Y-AXIS IS RICH/LEAN REVERSE DELAY TIME,

FRONT FEEDBACK INTEGRAL CONNECTION AMOUNT, OR FRONT FEEDBACK SKIP CORRECTION AMOUNT.

REAR FEEDBACK INTEGRAL VALUE $I_{RL}$ IS CHANGED AT EVERY PREDETERMINED TIME ($T_K$) PASSAGE $I_{RL}$: REAR $O_2$ INTEGRAL VALUE $S_{RL}$, $S_{LR}$: REAR $O_2$ SKIP VALUE

RICH/LEAN REVERSE DELAY ($D_{LR}$ / $D_{RL}$) TIME OF FRONT FEEDBACK VALUE IS CHANGED DEPENDING ON SOXFB (%).

Y-AXIS IS RICH/LEAN REVERSE DELAY TIME, FRONT FEEDBACK INTEGRAL CONNECTION AMOUNT, OR FRONT FEEDBACK SKIP CORRECTION AMOUNT.

CONDITIONS FOR EFFECTING REAR $O_2$ FEEDBACK

AIR-FUEL RATIO CONTROL DEVICE FOR INTERNAL COMBUSTION ENGINE

FIELD OF THE INVENTION

This invention relates to an air-fuel ratio control device for an internal combustion engine, and particularly to an air-fuel ratio control device for an internal combustion engine, in which a first exhaust sensor is disposed at an exhaust passage of an internal combustion engine on an upstream side of a catalytic member which is disposed at the exhaust passage, and a second exhaust sensor is disposed at the exhaust passage on a downstream side of the catalytic member, with the air-fuel ratio being feedback-controlled by a control system in accordance with detection signals from the front and rear exhaust sensors.

This invention also relates to an air-fuel ratio control device for an internal combustion engine, and particularly to an air-fuel ratio control device for an internal combustion engine for stopping even a second feedback control in accordance with a second detection signal from a second exhaust sensor when the internal combustion engine is in a mode other than a steady driving mode, and for correcting the first feedback controlling state based on a learned value of the second feedback control during a period from the start of the first feedback control until the start of the second feedback control, thereby maintaining a logical air-fuel ratio in order to reduce a generation of a harmful component of exhaust.

BACKGROUND OF THE INVENTION

Among internal combustion engines mounted on vehicles, there are those which are provided with an air-fuel ratio control device. The air-fuel ratio control device includes a sensor which is disposed at an exhaust passage to detect, for example, oxygen concentration as a component value of the exhaust gas, a feedback control being effected such that the air-fuel ratio is brought into a target value by adjusting a quantity of fuel and/or a quantity of air with reference to a feedback control value calculated based on a detection signal outputted from the oxygen sensor, in order to enhance purification efficiency of the exhaust gas by a catalytic member, thereby reducing the harmful component value of the exhaust gas.

An air-fuel ratio control device for an internal combustion engine of the type mentioned above is disclosed in a Japanese Early Laid-Open Patent Publication Sho 61-234241. This air-fuel ratio control device comprises a first oxygen sensor disposed at an exhaust passage on an upstream side of a catalytic member which is disposed at the exhaust passage of an internal combustion engine, and a second oxygen sensor disposed at the exhaust passage on a downstream side of the catalytic member, a skip amount of a first feedback control value, which is calculated with reference to a first detection signal outputted from the first oxygen sensor, being corrected by a second detection signal outputted from the second oxygen sensor, in order to prevent a lowering of responsiveness due to deterioration of the first oxygen sensor. More specifically, a skipping amount calculating means calculates a skipping amount as an air-fuel ratio feedback control constant in accordance with the output of the downstream sensor, and an air-fuel ratio correcting amount calculating means calculates an air-fuel ratio correcting amount in accordance with an output of the upstream sensor using the skipping amount. An air-fuel ratio adjusting means adjusts the air-fuel ratio of the engine in accordance with the air-fuel ratio correcting amount in order to prevent a lowering of responding speed.

In such an air-fuel ratio control device for an internal combustion engine comprising a first oxygen sensor disposed at an exhaust passage on an upstream side of a catalytic member which is disposed at the exhaust passage of an internal combustion engine, and a second oxygen sensor disposed at the exhaust passage on a downstream side of the catalytic member, the first feedback control is effected such that the air-fuel ratio is brought into a target value with reference to the first feedback control value (OXFB) calculated with reference to the first detection signal outputted from the first oxygen sensor as shown in FIG. 5, and the second feedback control is effected in order to correct reverse delay time ($D_{LR}$, $D_{RL}$) of a first feedback control value (OXFB) at the time when the first detection signal is reversed between a rich signal and a lean signal as shown in FIG. 7, with reference to a second feedback control value (SOXFB) which is calculated based on the second detection signal outputted from the second oxygen sensor as shown in FIG. 6, so that the feedback control to be effected with the aid of the first oxygen sensor is prevented from being shifted from the control center. The air-fuel ratio reverse delay time ($D_{LR}$, $D_{RL}$) when used herein refers to the time required for effecting a procedure for regarding that a change is delayed for a predetermined time when the first detection signal is changed from a rich signal to a lean signal or when the first detection signal is change from a lean signal to a rich signal.

Also, in this air-fuel ratio control device, the second detection signal outputted from the second oxygen sensor is skipped based on the respective skip values ($S_{RL}$, $S_{LR}$), when the second detection signal is reversed between the rich signal and the lean signal, and respective durations of time ($T_R$, $T_L$) of the rich signal and lean signal of the second detection signal are judged every integral value judging time $t_k$, and an integral value ($I_{RL}$) determined based on the duration of time $T_R/T_L$ is increased/decreased every integral value judging time $t_k$.

However, in an air-fuel ratio control device of the type mentioned above, as shown in FIGS. 2 to 4, a cycle or a frequency (hereinafter referred to as the "cycle") ($T_{RE}$) of the second detection signal from the second oxygen sensor is changed in accordance with deterioration of the catalytic member with respect to a cycle or frequency ($T_{FR}$) of the first detection signal from the first oxygen sensor. That is, when the catalytic member is deteriorated, the cycle ($T_{RE}$) of the second detection signal is reduced (or becomes short) at the time when the catalytic member is deteriorated as shown in FIG. 4 relative to the cycle ($T_{RE}$) of the second detection signal at the time when the catalytic member is deteriorated as shown in FIG. 3, and it is brought to be closer to the cycle ($T_{FR}$) of the first detection signal of the first oxygen sensor. As a result, the respective durations of time ($T_R$, $T_L$) of the rich signal and lean signal are changed at the time when the catalytic member is new and therefore not deteriorated, and at the time when the catalytic member is used for a long period of time and therefore deteriorated.

If the integral value judging time $t_k$ is kept constant against change in respective durations of time ($T_R$, $T_L$) of the rich signal and lean signal of the second detection signal due to deterioration of the catalytic member, the second feedback control value (SOXFB) obtainable with the aid of the second oxygen sensor is extensively changed both at the time when the catalytic member is not deteriorated and when the catalytic member is deteriorated. It gives rise to the problem that the air-fuel ratio reverse delay time ($D_{LR}$, $D_{RL}$) of the first feedback control value (OXFB), which is obtainable with the aid of the first oxygen sensor, is shifted.

As a result, there are such disadvantages that since the first feedback control to be effected with the aid of the first oxygen sensor is extensively shifted from the control center, the first feedback control cannot be effected accurately in order to bring the air-fuel ratio into the target value with the aid of the first oxygen sensor, and purification efficiency of the exhaust gas is deteriorated, thus making it impossible to reduce the harmful component value of the exhaust gas.

If, as mentioned above, the second feedback control is effected to correct the air-fuel ratio reverse delay time ($D_{LR}$, $D_{RL}$) of the first feedback control value (OXFB) at the time when the first detection signal is reversed between the rich signal and the lean signal, as shown in FIG. 7 with reference to the second feedback control value (SOXFB) which is calculated based on the second detection signal outputted from the second oxygen sensor, it gives rise to another problem that the first feedback control to be effected with the aid of the first oxygen sensor is excessively sensitively responded to the second feedback control to be effected with the aid of the second oxygen sensor.

Therefore, since the first feedback control to be effected with the aid of the first oxygen sensor is excessively sensitively responded to the extensive change of the second feedback control/SOXFB), the first feedback control to be effected with the aid of the first exhaust sensor cannot effect a stable response thereto. As a result, the first feedback control to be effected with the aid of the first oxygen sensor is shafted from the control center, and the first feedback control cannot be effected accurately in order to bring the air-fuel ratio into the target value with the aid of the first oxygen sensor, with the results that the purification efficiency of the exhaust gas is deteriorated thereby making it impossible to reduce the harmful component value of the exhaust gas.

More specifically, if the integral value judging time $t_k$ is constant with respect to change in the respective durations of time ($T_R$, $T_L$) of the rich signal and lean signal of the second detection signal due to deterioration of the catalytic member, when the integral value judging time $t_k$ becomes longer than the duration of time $t_a$ ($t_k \geqq t_a$) of, for example, the rich signal of the second exhaust detection signal due to deterioration of the catalytic member as shown in FIG. 8, the second detection signal is not reversed within the integral value judging time $t_k$.

In this way, when the integral value judging time $t_k$ becomes longer than the duration of time $t_a$ ($t_k \geqq t_a$), a judgment as to whether the second detection signal is the rich signal or the lean signal cannot be made. As a result, as shown in FIG. 9, the second oxygen feedback control value (SOXFB) obtainable with the aid of the second oxygen sensor cannot be changed to either side because of no generation of the integral value, and skipped in the neighborhood of the current value only based on the skip values ($S_{RL}$, $S_{LR}$). Therefore, as shown in FIG. 10, when the second feedback control is effected in order to correct the air-fuel ratio reverse delay time ($D_{LR}$, $D_{RL}$) of the first feedback control value (OXFB) based on the second feedback control value (SOXFB), the air-fuel ratio reverse delay time ($D_{LR}$, $D_{RL}$) of the first feedback control value (OXFB) obtainable with the aid of the first oxygen sensor is shifted, and the air-fuel ratio obtainable by the first feedback control is shifted from the control center where $\alpha=1$. As a result, the first feedback control cannot be effected accurately in order to bring the air-fuel ratio into the target value with the aid of the first oxygen sensor, with the results that the purification efficiency of the exhaust gas is lowered, thereby making it impossible to reduce the harmful component value of the exhaust gas.

Furthermore, as shown in FIGS. 11 and 12, when the catalytic member is not deteriorated because the member is new, the integral value ($I_{RL}$) is generated frequently to increase the amount of integration because the cycle of the second detection signal is long. As a result, the second feedback control value (SOXFB) is extensively changed. Since the second feedback control is effected in order to correct the air-fuel ratio reverse delay time ($D_{LR}$, $D_{RL}$) of the first feedback control value (OXFB) in accordance with the second feedback control value (SOXFB) which is extensively changed as mentioned, the air-fuel ratio reverse delay time ($D_{LR}$, $D_{RL}$) of the first feedback control value (OXFB) is uselessly changed to a long side or a short side. As a result, the first feedback control to be effected with the aid of the first oxygen sensor is excessively sensitively responded to the second feedback control, and the first feedback control cannot be responded stably. As a consequence, the air-fuel ratio obtainable as a result of the first feedback control is shifted from the control center where $\alpha=1$, and the first feedback control cannot be effected accurately in order to bring the air-fuel ratio into the target value with the aid of the first oxygen sensor, with the result that the purification efficiency is lowered, thereby making it impossible to reduce the harmful component value of the exhaust gas.

Furthermore, to set the integral value judging time $t_k$ increases the capacity of a control soft and increases the cost, and is thus economically disadvantageous.

The description of the aforementioned conventional control device is described in additional detail relative to FIGS. 2 to 12 on Attachment A.

In view of the above, the present invention in a first embodiment provides, in order to obviate the above inconveniences, an air-fuel ratio control device for an internal combustion engine comprising a first exhaust sensor disposed at an exhaust passage of the internal combustion engine on an upstream side of a catalytic member disposed at said exhaust passage, a second exhaust sensor disposed at said exhaust passage on a downstream side of said catalytic member, a first feedback control being effected such that an air-fuel ratio is brought into a target value with reference to a first feedback control value which is calculated with reference to a first detection signal outputted from said first exhaust sensor, a second feedback control being effected in order to correct said first feedback control value with reference to a second feedback control value which is calculated with reference to a second detection signal outputted from said second exhaust sensor, wherein said air-fuel ratio control device for the internal combustion engine is characterized in that it further comprises control means for feedback-controlling the air-fuel ratio by changing a correction judging time and a correction amount of said second feedback control of said second exhaust sensor in accordance with an output cycle of said second detection signal from said second exhaust sensor and calculating a second feedback control learning value with reference to an arithmetical mean which is calculated with reference to a value just before the preceding skip and a value just before a current or present skip every time said second feedback control value is skipped, and an arithmetical mean number which is calculated in accordance with a cycle state of the output of said second detection signal from said second exhaust sensor.

According to this embodiment of the invention, by virtue of the control means as aforesaid, the air-fuel ratio is feedback-controlled by changing a correction judging time and a correction amount of the second feedback control of the second exhaust sensor in accordance with an output cycle of the second detection signal from the second exhaust sensor and calculating a second feedback control learning value with reference to an arithmetical mean which is calculated with reference to a value just before the preceding skip and a value just before a present skip every time the second feedback control value is skipped, and an arithmetical mean number which is calculated in accordance with a cycle state of the output of the second detection signal from the second exhaust sensor.

The present invention in a second embodiment provides, in order to obviate the above inconveniences, an air-fuel ratio control device for an internal combustion engine as described above, characterized by a control means for effecting a second feedback control such that an arithmetical mean is calculated with reference to a value just before a preceding skip and a value just before a current or present skip every time said second feedback control value is skipped, an arithmetical mean number is calculated based both on a cycle of said first detection signal and a cycle of said second detection signal in accordance with deterioration of said catalytic member, and a learning value of the second feedback control of said second exhaust sensor is calculated with reference to said arithmetical mean and arithmetical mean number, in order to correct a reverse delay time of the air-fuel ratio of said first feedback control value with reference to such calculated learning value of the second feedback control.

According to the latter construction of the invention, a second feedback control is effected by the control means such that an arithmetical mean of a value just before a preceding skip and a value just before a current skip is calculated every time the second feedback control value is skipped with the aid of the second exhaust sensor and an arithmetical mean number is calculated based both on a cycle of the first detection signal and a cycle of the second detection signal in accordance with deterioration of the catalytic member and a learning value of the second feedback control of the second exhaust sensor is calculated with reference to the arithmetical mean and arithmetical mean number, in order to correct a reverse delay time of the air-fuel ratio of the first feedback control value with reference to such calculated learning value of the second feedback control. Accordingly, the first feedback control value obtainable with the aid of the first exhaust sensor can be corrected in accordance with deterioration of the catalytic member, and the first feedback control to be effected with the aid of the first exhaust sensor can be stably responded to the second feedback control to be effected by the second exhaust sensor, without being excessively sensitively responded thereto.

The present invention in a third embodiment provides, in order to obviate the above inconveniences, an air-fuel ratio control device for an internal combustion engine as described above, characterized by a control means in which when the air-fuel ratio is feedback-controlled, an integral value judging time for the feedback-control of the rear exhaust sensor is found based on a detection value indicating an output state of the front exhaust sensor and another detection value indicating an output state of the rear exhaust sensor which is changed in accordance with deterioration of the catalyst converter, and an integral amount is found, and the air-fuel ratio is feedback-controlled in accordance with the deterioration of the catalyst converter based on such obtained integral value judging time and integral amount.

By virtue of this latter construction of the invention, when the air-fuel ratio is feedback-controlled, the feedback controlling integral value judging time of the rear exhaust sensor is found with reference to the detection value indicating the output state of the front exhaust sensor which is inputted to the control means, and another detection value indicating the output state of the rear exhaust sensor which is varied in accordance with deterioration of the catalyst converter, and the integral value is found, and the air-fuel ratio is feedback-controlled in accordance with deterioration of the catalyst converter based on the integral value judging time and integral amount, thereby enhancing purification efficiency of the exhaust gas of the catalyst converter.

Embodiments of the present invention will now be described in detail with reference to the drawings.

BRIEF DESCRIPTION OF THE DRAWINGS

FIG. 43 is a view showing the relation between a deteriorated state of the catalytic member and an integral value (amount).

FIG. 44 is an explanatory view of a learn control in the second feedback control by the rear $O_2$ sensor;

DETAILED DESCRIPTION

Figure 1:
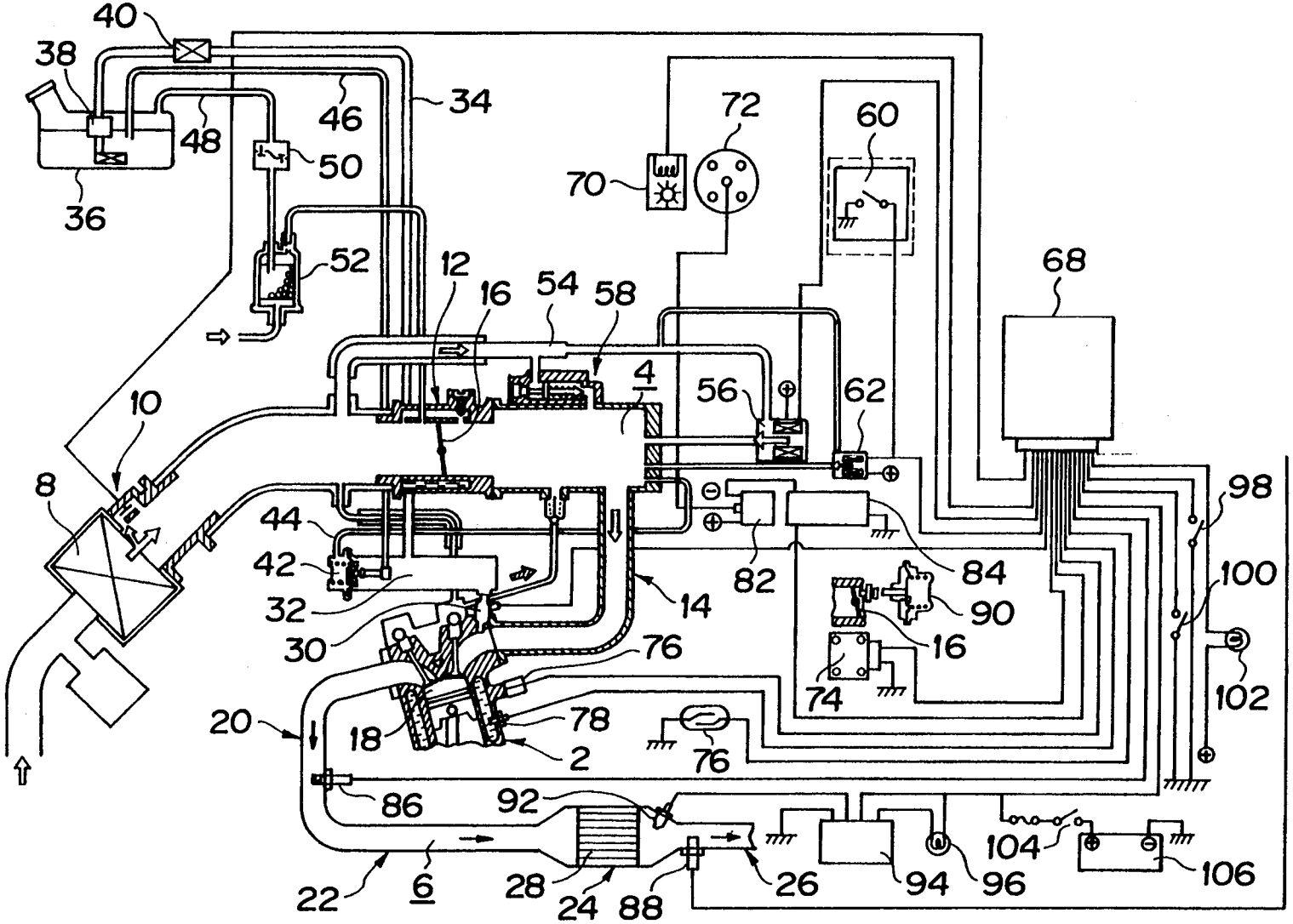
FIG. 1 is a view showing a construction of an air-fuel ratio control device for an internal combustion engine embodying the present invention.

FIG. 1 in conjunction with FIGS. 13–20 show one embodiment of an air-fuel ratio control device according to the present invention.

In FIG. 1, 2 denotes an internal combustion engine, 4 an air inlet passage, and 6 an exhaust passage. The air inlet passage 4 of the internal combustion engine 2 comprises an air cleaner 8, an air flowmeter 10, a throttle body 12, and an intake manifold 14 connected in this order from an upstream side. The air inlet passage 4 within the throttle body 12 is provided with an inlet throttle valve 16. The inlet passage 4 is communicated with a combustion chamber 18 of the internal combustion engine 2.

The exhaust passage 6 leading to the combustion chamber 18 of the internal combustion chamber 2 comprises an outlet manifold 20, an upstream side exhaust pipe 22, a catalyst converter 24, and a downstream side exhaust pipe 26 connected in this order from an upstream side. The exhaust passage 6 within the catalyst converter 24 is provided with a catalytic member 28.

The internal combustion engine 2 is provided with a fuel injection valve 30 directing towards the combustion chamber 18. The fuel injection valve 30 is communicated with a fuel tank 36 by way of a fuel supply passage 34 through a fuel distribution passage 32. A fuel pump 38 is disposed within the fuel tank 36. Dust, etc. contained in fuel fed by the fuel pump 38 is removed by a fuel filter 40, and then the fuel is supplied to the fuel distribution passage 32 by way of the fuel supply passage 34 so as to be distributed to the fuel injection valve 30.

The fuel distribution passage 32 is provided with a fuel pressure adjusting portion 42 adapted to adjust the pressure of fuel. The fuel pressure adjusting portion 42 is operated to adjust the pressure of fuel so as to have a constant value with an intake pressure introduced through a pressure guide passage 44 communicated with the inlet passage 4 and return surplus fuel to the fuel tank 36 by way of a fuel return passage 46.

The fuel tank 36 is communicated with the inlet passage 4 of the throttle body 12 by way of an evaporation fuel passage 48. This evaporation fuel passage 48 is provided at an intermediate portion thereof with a two-way valve 50, and a canister 52 arranged in this order from the fuel tank 36 side. A bypass passage 54 for communicating with the inlet passage 4 is disposed in such a manner as to bypass the inlet throttle valve 16 of the throttle body 12. This bypass passage 54 is provided at an intermediate portion thereof with an idle air quantity control valve 56 adapted to stabilize the number of engine rotations at idle by increasing/decreasing the amount of bypass air. The numeral 58 denotes an air regulator, 60 a power steering switch, 62 a power steering air quantity control valve, 64 a blowby gas passage, and 66 a PCV valve.

The air flowmeter 10, the fuel injection valve 30, the idle air quantity control valve 56, and the power steering air quantity control valve 62 are connected to a control portion 68 acting as a control means. Connected to the control means 68 are an engine crank angle sensor 70, a distributor 72, an opening sensor 74 of the inlet throttle valve 16, a knock sensor 76, a water temperature sensor 78, and a vehicle speed sensor 80. The distributor 72 is connected to the control portion 68 through an ignition coil 82 and an ignition power unit 84.

The internal combustion engine 2 is provided at the exhaust passage 6 on an upstream side of the catalytic member 28 with a first oxygen sensor 86 acting as the exhaust sensor, adapted to detect the concentration of oxygen as a component value of the exhaust gas, and at the exhaust passage 6 on a downstream side of the catalytic member 28 with a second oxygen sensor 88 acting as the exhaust sensor, adapted to detect the concentration of oxygen as a component value of the exhaust gas. The first oxygen sensor 86 and the second oxygen sensor 88 are connected to the control means 68.

The control means 68 is operated to effect a first feedback control in order to bring an air-fuel ratio into a target value with reference to a first feedback control value (OXFB) which is calculated based on a first detection signal outputted from the first oxygen sensor 86, and to effect a second feedback control in order to correct the first feedback control value (OXFB) with reference to the second feedback control value (SOXFB) which is calculated based on a second detection signal outputted from the second oxygen sensor 88.

In the air-fuel ratio control device for the internal combustion engine 2 thus constructed, the second feedback control is effected by the control means 68 such that a correction judging time and a correction amount of the second feedback control of the second exhaust sensor are changed in accordance with an output cycle, for example, reverse cycle, of the second detection signal from the second exhaust sensor, and a second feedback control learning value (SOXFLAV) is calculated with reference to an arithmetical mean (SOXFBAV) which is calculated with reference to a value just before the preceding skip and a value just before a current skip every time the second feedback control value is skipped, and an arithmetical mean number (X) which is calculated in accordance with a cycle state, for example, reverse cycle, of the output of the second detection signal from the second exhaust sensor.

In FIG. 1, numeral 90 denotes a dash pot, 92 a thermo-fuse, 94 an alarm relay, 96 an alarm lamp, 98 a diagnosis switch, 100 a TS switch, 102 a diagnosis lamp, 104 a main switch, and 106 a battery.

Figure 13:
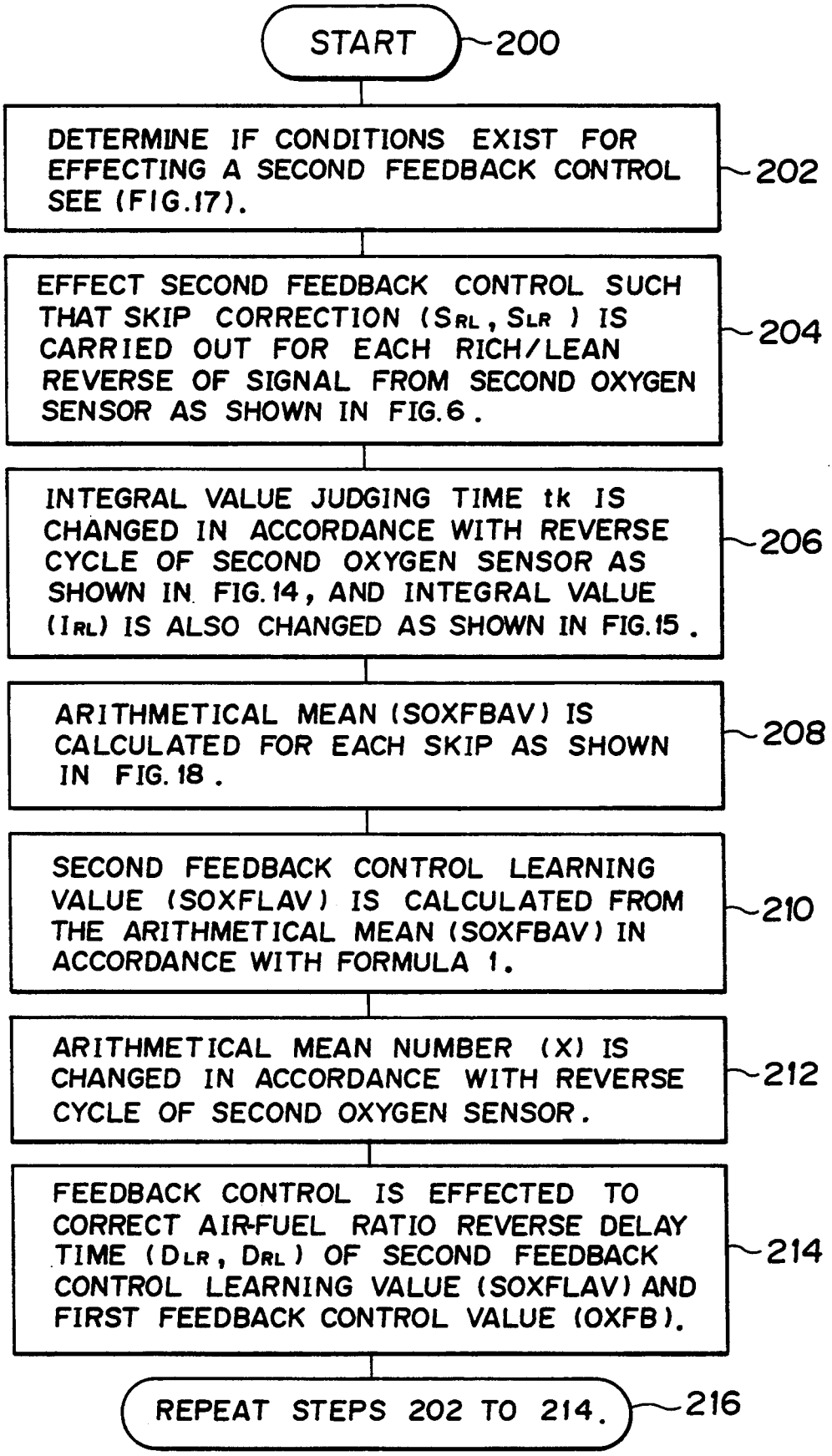
FIG. 13 is a flow chart of an air-fuel ratio control device for an internal combustion engine showing one embodiment of the present invention.

Next, the control to be effected by the air-fuel ratio control device will be described with reference to FIG. 13.

When the internal combustion engine 2 is started and a control program is started at Step 200, conditions for effecting the second feedback-control of the second oxygen sensor 88 is judged at Step 202.

Figure 17:
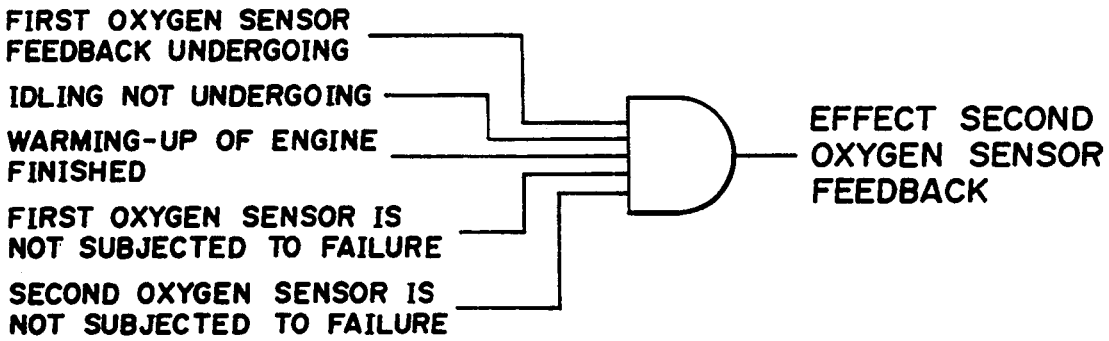
FIG. 17 is a logic circuit of conditions for effecting a second feedback control.

This judgment at Step 202 is made by determining whether or not all of the following conditions shown in FIG. 17 are satisfied, i.e., the first feedback control is undergoing with the aid of the first oxygen sensor 86, the internal combustion engine 2 is not in an idling condition, the internal combustion engine 2 has already finished its warming-up operation, the first oxygen sensor 86 is not subjected to a failure, and the second oxygen sensor 88 is not subjected to a failure.

If it is determined at Step 202 that any one of the conditions shown in FIG. 17 is not satisfied, the second feedback control to be effected with the aid of the second oxygen sensor 88 is not effected. In contrast, if it is determined at Step 202 that all conditions shown in FIG. 17 are satisfied, then the second feedback control is effected with the aid of the second oxygen sensor 88 at Step 204.

Figure 6:
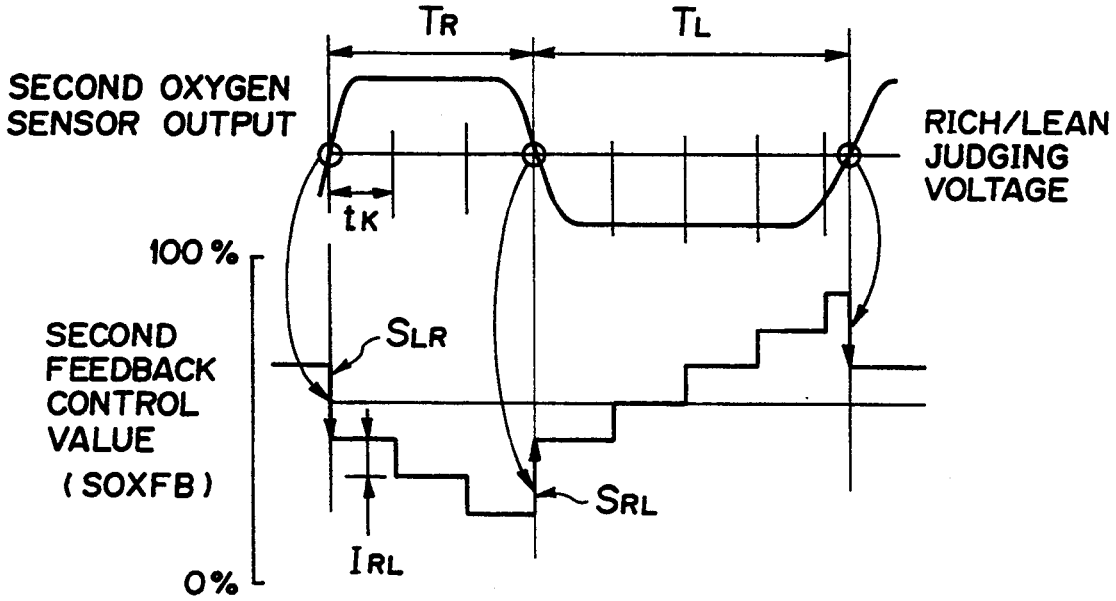
FIG. 6 PRIOR ART
FIG. 6 is a view of a waveform showing the relation between a second detection signal of a second oxygen sensor and a second feedback control value (SOXFB), according to the prior art.

This second feedback-control is effected such that, as shown in FIG. 6, the skip values ($S_{RL}$, $S_{LR}$) are increased/decreased every time the second detection signal, as outputted from the second oxygen sensor 88, is reversed between the rich signal and the lean signal.

Figure 14:
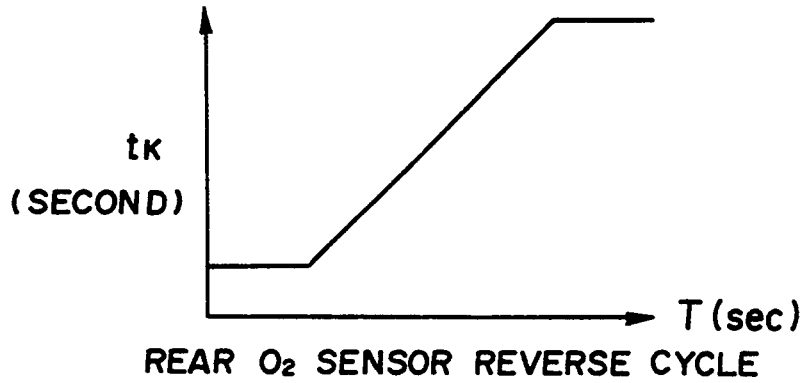
FIG. 14 is a view showing the relation between the reverse cycle of the second oxygen sensor and the integral value judging time.
Figure 15:
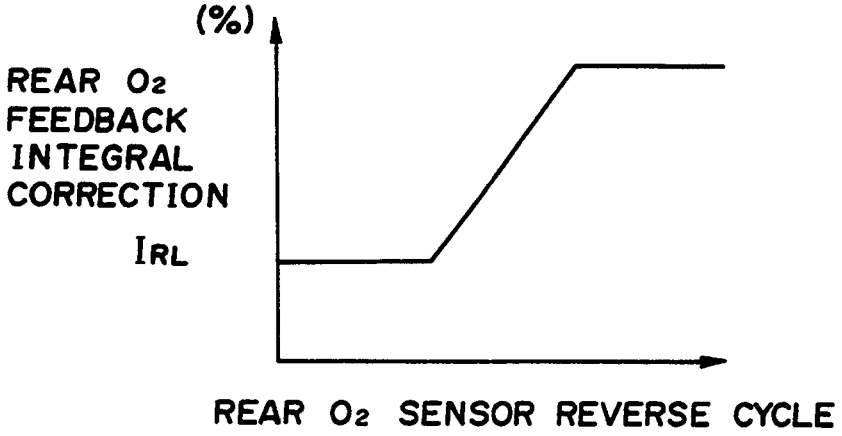
FIG. 15 is a view showing the relation between the reverse cycle of the second oxygen sensor and the integral value.

After the determination at Step 202 is effected, the integral value judging time $t_k$ is changed in accordance with the reverse cycle of the second oxygen sensor 88, as shown in FIG. 14, and the integral value ($I_{RL}$) is also changed, as shown in FIG. 15, at Step 206.

Figure 18:
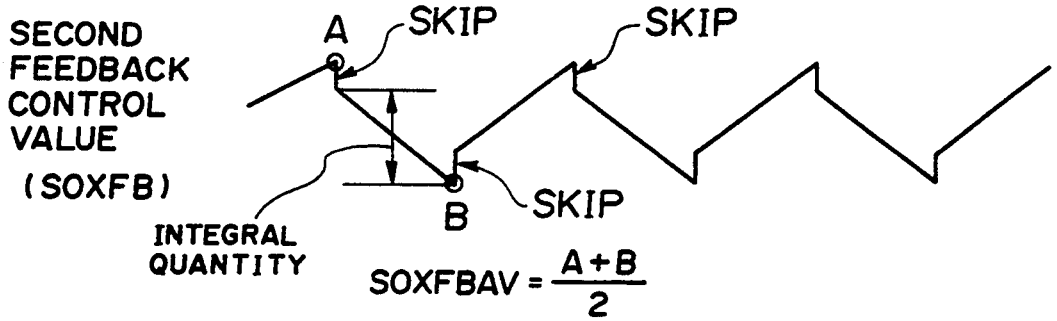
FIG. 18 is a view showing a second feedback value (SOXFS)

And, the arithmetical mean (SOXFBAV) of a value just before the preceding skip and a value B just before a current skip, as shown in FIG. 18, is calculated at Step 208 every time the second feedback control value (SOXFB) is skipped, from SOXFBAV=(A+B/2).

The second feedback control learning value (SOXFLAV) is calculated at Step 210 from the arithmetical mean value (SOXFBAV) calculated at Step 208 above in order to correct the air-fuel ratio reverse delay time ($D_{LR}$, $D_{RL}$) of the first feedback control value (OXFB). This calculation is based on Formula 1 presented below.

Formula 1:

$$SOXFLAV = \left( \sum_{i=1}^{x-1} SOXFBAV_i + SOXFBAV_x \right) / x$$

Figure 16:
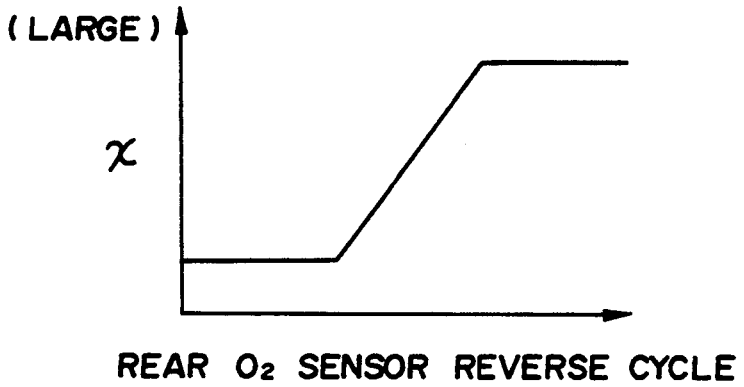
FIG. 16 is a view showing the relation between the reverse cycle of the second oxygen sensor and the arithmetical mean number.

Next, the arithmetical mean number expressed by X in Formula 2 (as presented below) is changed at Step 212 based on the reverse cycle of the second oxygen sensor 88 as shown in FIG. 16.

Formula 2:

$$SOXFLAV = \left( \sum_{i=1}^{x-1} SOXFBAV_i + SOXFBAV_x \right) / x$$

Figure 19:
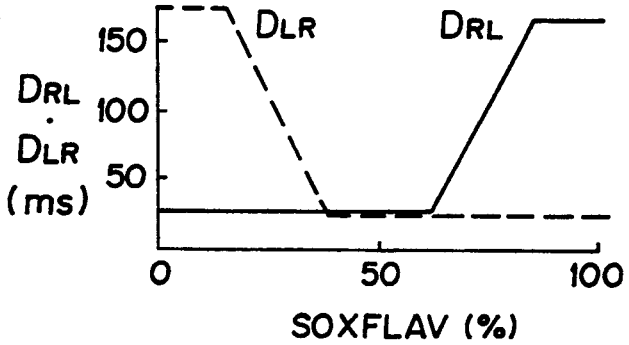
FIG. 19 is a view showing the relation between a second feedback control learning value (SOXFLAV) and a first feedback control value (OXFB), and an air-fuel ratio reverse delay time ($D_{LR}$, $D_{RL}$)
Figure 20:
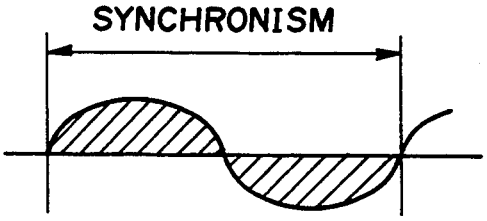
FIG. 20 is a view showing the area of the cycle of a second oxygen sensor.

As shown in FIG. 19, the second feedback control at Step 214 is effected in accordance with the calculated second feedback control learning value (SOXFLAV) (as determined at Step 210 above) in order to correct the air-fuel ratio reverse delay time ($D_{LR}$, $D_{RL}$) of the first feedback control value (OXFB).

At Step 216, the above procedures of Step 202 to Step 214 are repeatedly performed.

By this, the second rear feedback learning value (SOXFLAV) can easily be calculated utilizing the reverse cycle of the second oxygen sensor 88, the air-fuel ratio can be accurately feedback-controlled to a target value by the first oxygen sensor 86 based on this second feedback learning value (SOXFLAV), exhaust purification efficiency can be enhanced, and the exhaust harmful component value can be reduced.

Furthermore, by calculating the second feedback learning value (SOXFLAV) utilizing the reverse cycle of the second oxygen sensor 88, the control program can be simplified without lowering the efficiency, manufacture can easily be carried out, and cost can be maintained at a lower level, and is thus economically advantageous.

The present invention is not limited to the above-mentioned embodiment, but it can be modified into various forms.

Figure 9:
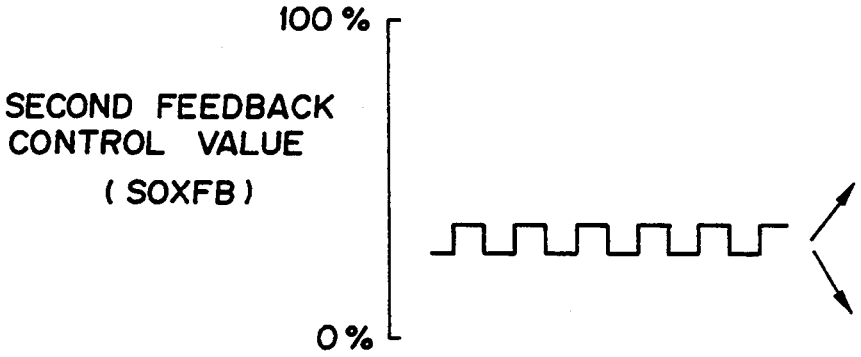
FIG. 9 PRIOR ART
FIG. 9 is a view showing a second feedback control value (SOXFB) when a catalytic member is in a deteriorated condition, according to the prior art.

For example, in this embodiment, although the control program is prepared such that the second feedback learning value (SOXFLAV) is calculated utilizing the reverse cycle of the second oxygen sensor, the control program may be prepared such that the second feedback learning value (SOXFLAV) is calculated utilizing the area of one cycle of the second oxygen sensor, as illustrated by FIG. 9.

FIG. 1 in conjunction with FIGS. 21–27 illustrate a second embodiment of the present invention.

In the air-fuel ratio control device for the internal combustion engine 2 constructed according to this second embodiment, the second feedback control is effected by the control means 68 such that an arithmetical mean (SOXFBAV) of a value just before a preceding skip and a value just before a current skip is calculated every time the second feedback control value (SOXFB) is skipped, an arithmetical mean number (X) is calculated based both on a cycle ($T_{FR}$) of the first detection signal and a cycle ($T_{RE}$) of the second detection signal in accordance with the deterioration of the catalytic member 28, and a learning value (SOXFLAV) of the second feedback control of the second oxygen sensor 88 is calculated with reference to the arithmetical mean (SOXFBAV) and the arithmetical mean number (X), in order to correct a reverse delay time ($D_{LR}$, $D_{RL}$) of the air-fuel ratio of the first feedback control value (OXFB) with reference to such calculated learning value (SOXFLAV) of the second feedback control.

Figure 21:
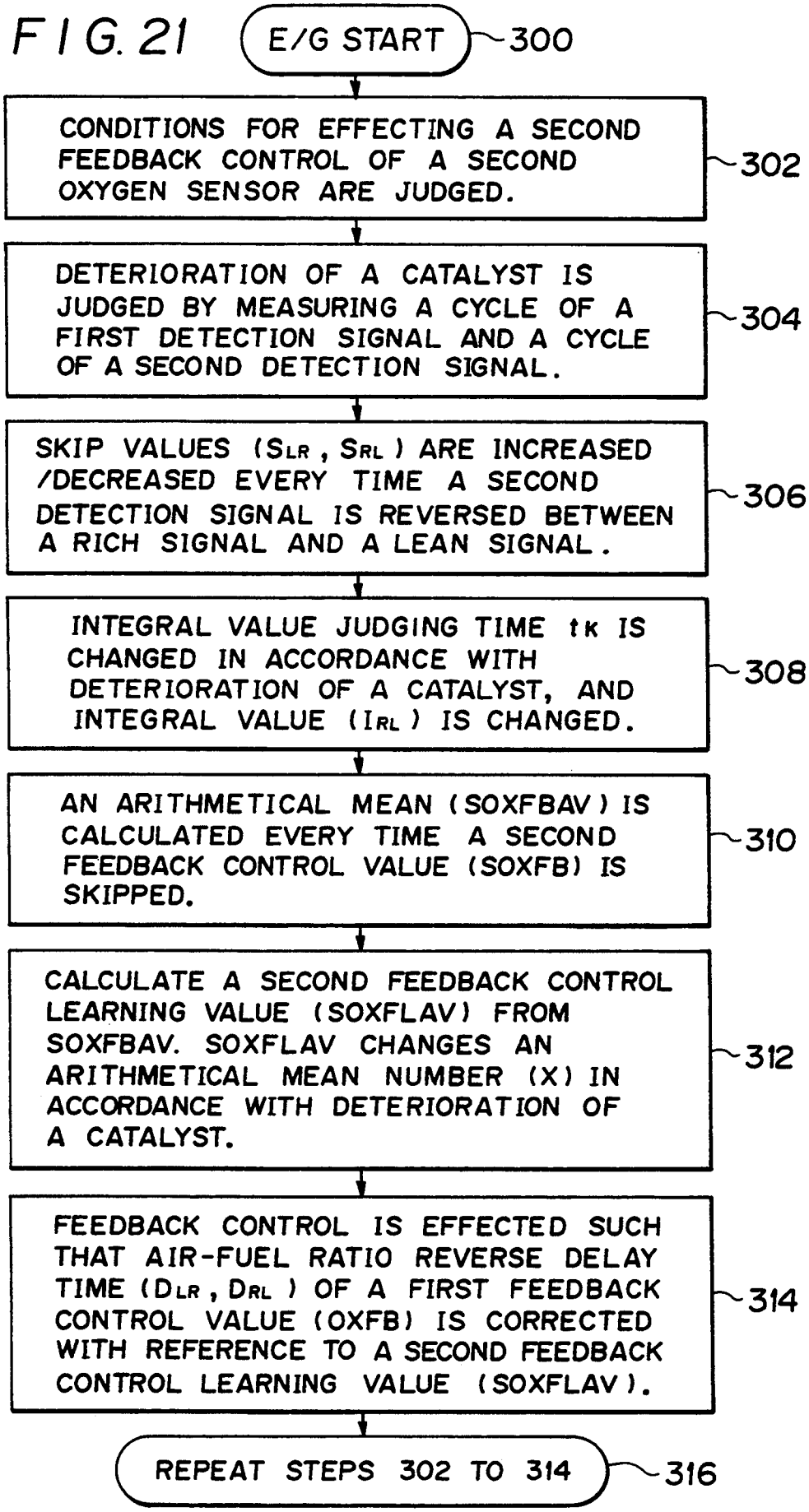
FIG. 21 is a flow chart for control of the air-fuel ratio control device according to a second embodiment of the invention.

The control to be effected by this second embodiment of the air-fuel ratio control device will be described with reference to FIG. 21.

When the internal combustion engine 2 is started at Step 300, conditions for effecting the second feedback control of the second oxygen sensor 88 are judged at Step 302. This judgment is made by determining whether or not all of the following conditions shown in FIG. 22 are satisfied, i.e., the first feedback control is undergoing with the aid of the first oxygen sensor 86, the internal combustion engine 2 is not in an idling condition, the internal combustion engine 2 has already finished its warming-up operation, the first oxygen sensor 86 is not subjected to a failure, and the second oxygen sensor 88 is not subjected to a failure.

Figure 22:
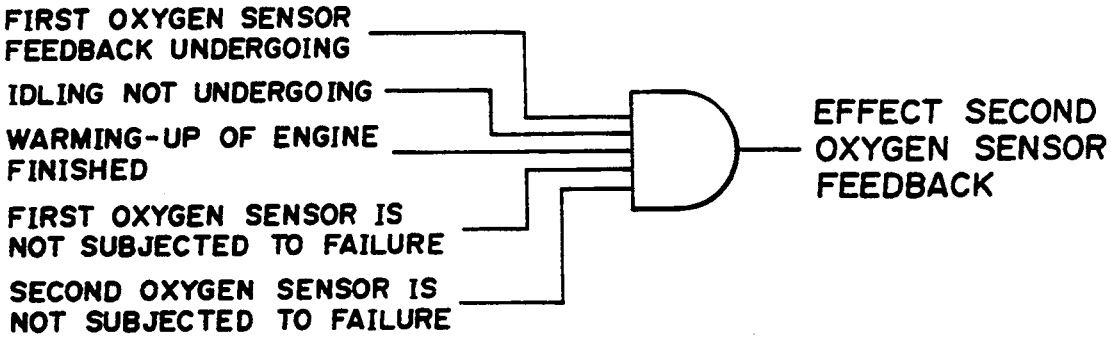
FIG. 22 is a logic circuit of conditions for effecting a second feedback control.

If it is judged at Step 302 that any one of the conditions shown in FIG. 22 is not satisfied, the second feedback control is not effected. In contrast, if it is determined at Step 302 that all conditions shown in FIG. 22 are satisfied, the second feedback control is effected at Step 304 with the aid of the second oxygen sensor 88.

Figure 2:
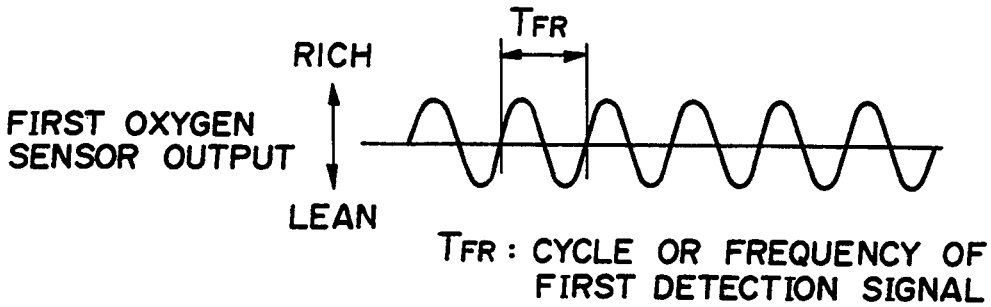
FIG. 2 PRIOR ART
FIG. 2 is a view of a waveform of a first detection signal of a first oxygen sensor, according to the prior art.
Figure 3:
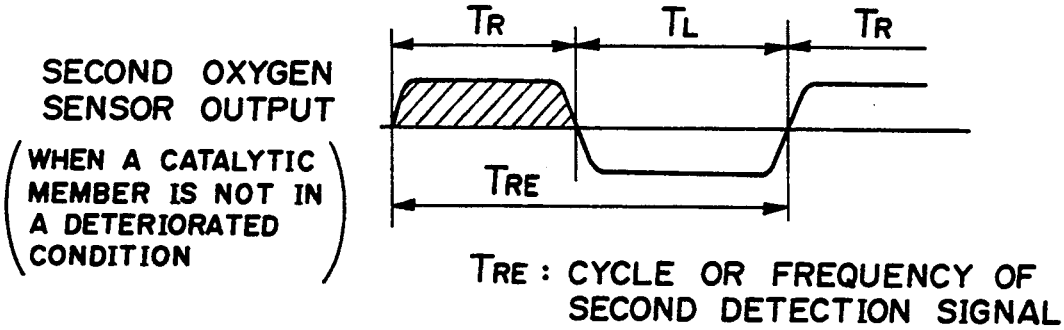
FIG. 3 PRIOR ART
FIG. 3 is a view of a waveform of a second detection signal of a second oxygen sensor when a catalytic member is not in a deteriorated condition, according to the prior art.

When the second feedback control is effected at Step 304 with the aid of the second oxygen sensor 88 because all conditions shown in FIG. 22 are satisfied, as shown in FIGS. 2 and 3, the cycle ($T_{FR}$) of the first detection signal of the first oxygen sensor 86 and the cycle ($T_{RE}$) of the second detection sensor of the second oxygen sensor 88 are measured, and the deteriorating state of the catalytic member 28 is judged (Step 304) with reference to the cycles ($T_{FR}$, $T_{RE}$).

Next, the second feedback control value (SOXFB) of the second feedback control, as shown in FIG. 6, is increased/decreased in skip values ($S_{RL}$, $S_{LR}$) at Step 306 every time the second detection signal outputted from the second oxygen sensor 88 is reversed between the rich signal and the lean signal, and the skip control is effected. The second feedback control value (SOXFB) is increased/decreased in integral value ($I_{RL}$) every integral value judging time $t_k$ based on the durations of time ($T_R$, $T_L$) of the rich signal and lean signal of the second detection signal outputted from the second oxygen sensor 88 to effect the integral control.

Figure 23:
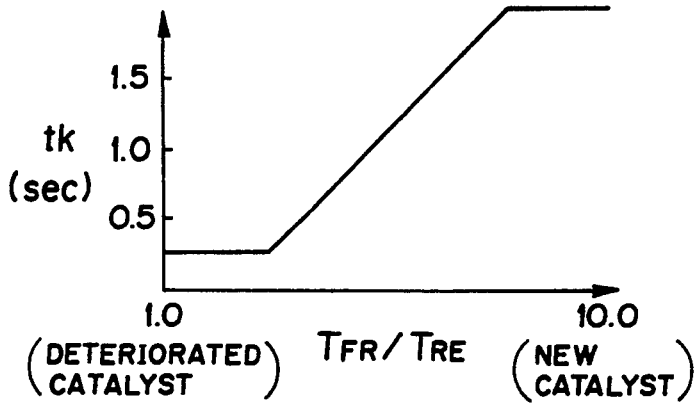
FIG. 23 is a view showing the relation between a cycle ($T_{FR}$) of a first detection signal and a cycle ($T_{RE}$) of a second detection signal, and an integral value judging time $t_k$.
Figure 24:
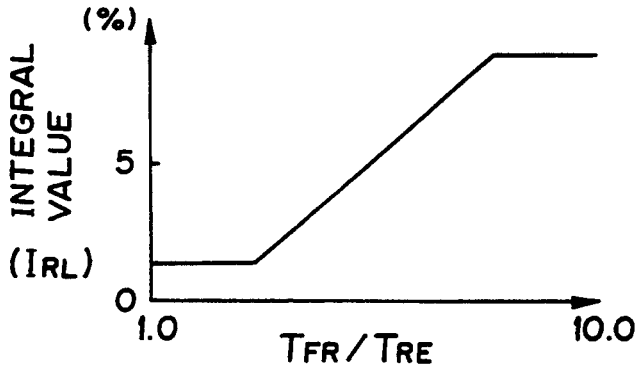
FIG. 24 is a view showing the relation between a cycle ($T_{FR}$) of a first detection signal and a cycle ($T_{RE}$) of a second detection signal, and an integral value ($I_{RL}$)

The second feedback control value (SOXFB) of the second feedback control changes the integral value judging time $t_k$, as shown in FIG. 23, in accordance with deterioration of the catalytic member 28 based on the cycles ($T_{FR}$, $T_{RE}$) in the judgment at Step 304, and changes (at Step 308) even the integral value ($I_{RL}$), as shown in FIG. 24, in accordance with deterioration of the catalytic member 28 in judgment Step 304.

Figure 25:
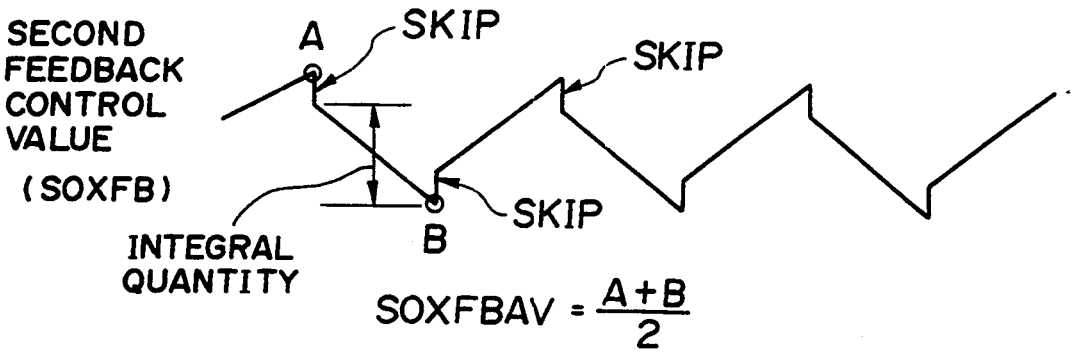
FIG. 25 is a view showing a second feedback value (SOXFS)

And, as shown in FIG. 25, the arithmetical mean (SOXFBAV) of a value (A) just before the preceding skip and a value (B) just before a current skip is calculated at Step 310 every time the second feedback control value (SOXFB) is skipped, whereby SOXFBAV=-(A+B/2).

Figure 26:
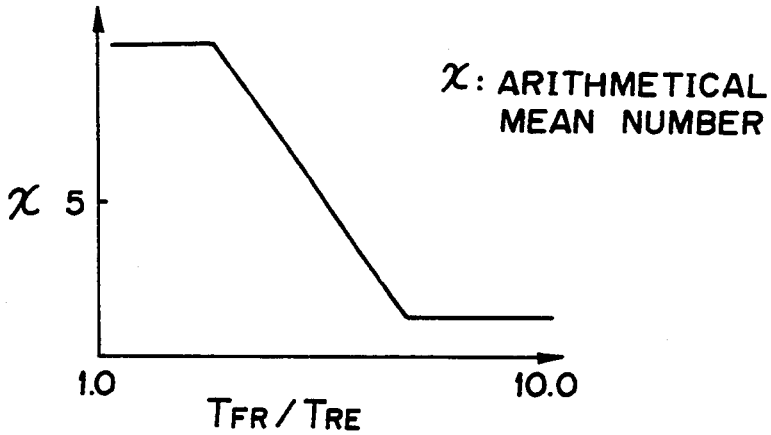
FIG. 26 is a view showing the relation between a cycle ($T_{FR}$) of a first detection signal and a cycle ($T_{RE}$) of a second detection signal, and an arithmetical mean number (X)

The second feedback control learning value (SOXFLAV) is calculated at Step 312 from the calculated arithmetical mean (SOXFBAV) in order to correct the air-fuel ratio reverse delay time ($D_{LR}$, $D_{RL}$) of the first feedback control value (OXFB). That is, as shown in FIG. 26, the arithmetical mean number (X) is calculated with reference to the cycle ($T_{FR}$) of the first detection signal and the cycle ($T_{RE}$) of the second detection signal in accordance with the deterioration of the catalytic member 28. The arithmetical mean number (X) is changed in accordance with the deterioration of the catalytic member 28. The second feedback learning value (SOXFLAV) is calculated in accordance with Formula 1 above, and with reference to the arithmetical mean (SOXFBAV) and the arithmetical mean number (X).

The second feedback control learning value (SOXFLAV) is obtained by finding a value of the arithmetical mean number (X) based on FIG. 26, and introducing the value of such obtained arithmetical mean number (X) into Formula 1. In this case, as apparent from FIG. 26, the larger the degree of newness of the catalytic member 28, and the lesser the deteriorating degree thereof, the smaller the arithmetical mean number (X) becomes in value. The reason is that when the catalytic member 28 is new, the cycle ($T_{RE}$) of the second detection signal outputted from the second oxygen sensor 88 is long, and therefore the sampling time becomes too long unless the take-in value for calculating the average is small.

Figure 5:
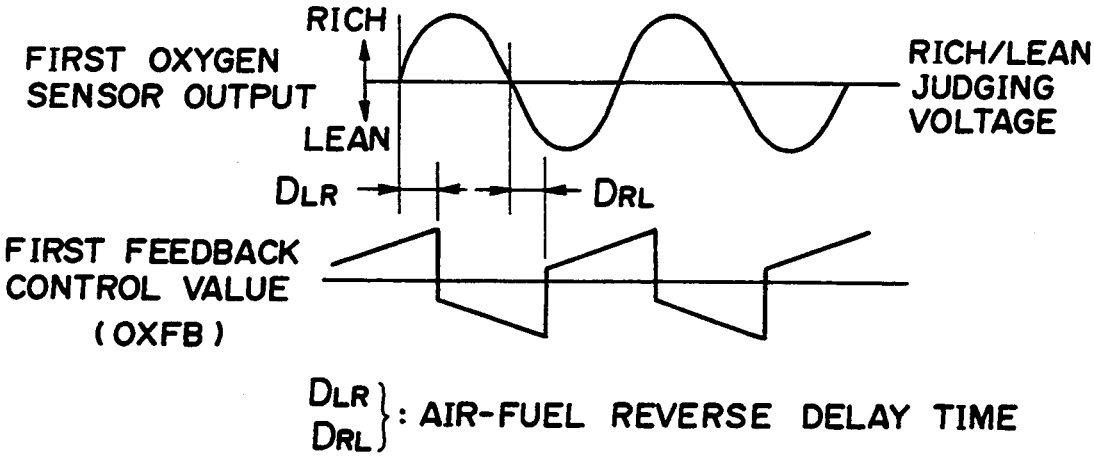
FIG. 5 PRIOR ART
FIG. 5 is a view of a waveform showing the relation between a first detection signal of a first oxygen sensor and a first feedback control value (OXFB), according to the prior art.
Figure 27:
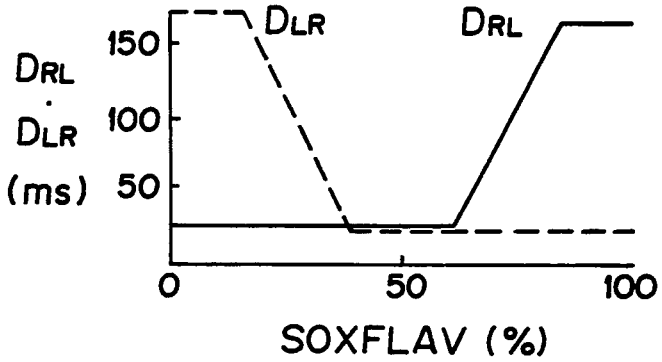
FIG. 27 is a view showing a relation between a second feedback control learning value (SOXFLAV) and a first feedback control value (OXFB), and an air-fuel ratio reverse delay time ($D_{LR}$, $D_{RL}$).

As shown in FIGS. 27 and 5, the second feedback control (at Step 314) is effected in accordance with such calculated second feedback control learning value (SOXFLAV) in order to correct the air-fuel ratio reverse delay time ($D_{LR}$, $D_{RL}$) of the first feedback control value (OXFB).

The control is effected by repeating at Step 316 the procedures of above Step 302 to Step 314.

In this way, by the control portion 68, an arithmetical mean (SOXFBAV) of a value just before the preceding skip and a value just before a current skip is calculated every time the second feedback control value (SOXFB) is skipped, and an arithmetical mean number (X) is calculated based both on a cycle ($T_{FR}$) of the first detection signal and a cycle ($T_{RE}$) of the second detection signal in accordance with deterioration of the catalytic member 28, and a learning value (SOXFLAV) of the second feedback control of the second oxygen sensor 88 is calculated with reference to the arithmetical mean (SOXFBAV) and the arithmetical mean number (X), and the second feedback control is effected in order to correct a reverse delay time ($D_{LR}$, $D_{RL}$) of the air-fuel ratio of the first feedback control value (OXFB) with reference to such calculated learning value (SOXFLAV) of the second feedback control.

As a consequence, the first feedback control value (OXFB) can be corrected with the aid of the first exhaust sensor 86 in accordance with deterioration of the catalytic member 28, and the first feedback control to be effected with the aid of the first exhaust sensor 86 can be stably responded to the second feedback control to be effected with the aid of the second exhaust sensor 88 and without being excessively sensitively responded thereto.

Figure 4:
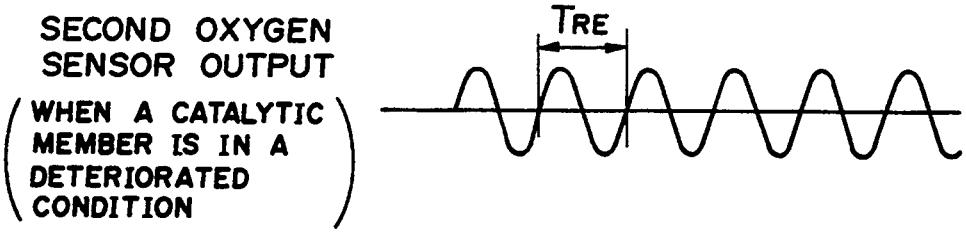
FIG. 4 PRIOR ART
FIG. 4 is a view of a waveform of a second detection signal of a second oxygen sensor when a catalytic member is in a deteriorated condition, according to the prior art.

Specifically, the cycle ($T_{RE}$) of the second detection signal of the second oxygen sensor 88 becomes short relative to the cycle ($T_{FR}$) of the first detection signal of the first oxygen sensor 86 as deterioration of the catalytic member 28 proceeds as shown in FIG. 4, and therefore the durations of time ($T_R$, $T_L$) of the rich signal and lean signal of the second detection signal are changed at the time when the catalytic member 28 is not deteriorated because the member 28 is new, and at the time when the catalytic member 28 is deteriorated because the member 28 is used for a long period of time.

In this way, by changing the integral value judging time $t_k$ of the second feedback control value (SOXFB) without maintaining the time $t_k$ to be constant against the change of the durations of time ($T_R$, $T_L$) of the rich signal and lean signal of the second detection signal in accordance with the deterioration of the catalytic member 28, it can be prevented that the second feedback control value (SOXFB) is extensively changed, thereby enabling to prevent a shifting of the air-fuel ratio reverse delay time ($D_{LR}$, $D_{RL}$) of the first feedback control value (OXFB) obtainable with the aid of the first oxygen sensor 86.

As a result, the first feedback control to be effected with the aid of the first oxygen sensor 86 can be prevented from being shifted from the control center where $\alpha=1$, and the first feedback control can be effected accurately in order to bring the air-fuel ratio into the target value with the aid of the first oxygen sensor 86, thereby making it possible to enhance the purification efficiency of the exhaust gas to reduce the harmful component value of the exhaust gas.

Without effecting the second feedback control in order to correct the air-fuel ratio reverse delay time ($D_{LR}$, $D_{RL}$) of the first feedback control value (OXFB) of the first detection signal with reference to the second feedback control value (SOXFB) of the second oxygen sensor 88 as in the prior art, the second feedback control is effected in order to correct the air-fuel ratio reverse delay time ($D_{LR}$, $D_{RL}$) of the first feedback control value (OXFB) based on the second feedback control learning value (SOXFLAV) which is calculated based on the arithmetical mean (SOXFBAV) which is calculated every time the second feedback control value (SOXFB) is skipped and the arithmetical mean number (X) corresponding to the catalytic member 28 calculated based both on the cycle ($T_{FR}$) of the first detection signal and the cycle ($T_{RE}$) of the second detection signal.

As a result, the second feedback control value (SOXFB) is not extensively changed, and the first feedback control to be effected with the aid of the first exhaust sensor 86 can stably respond to the second feedback control to be effected with the aid of the second exhaust sensor 88 without excessively sensitively responding thereto. By this, it can be prevented that the first feedback control to be effected with the aid of the first oxygen sensor 86 is shifted from the control center, and the first feedback control can be effected accurately in order to bring the air-fuel ratio into the target value with the aid of the first oxygen sensor 86, thus enhancing the purification efficiency of the exhaust gas to reduce the harmful component value of the exhaust gas.

In this embodiment, the second feedback control is effected in order to correct the air-fuel ratio reverse delay time ($D_{LR}$, $D_{RL}$) of the first feedback control value (OXFB) based on the second feedback control learning value (SOXFLAV). However, the control may be effected in order to correct the integral value and skip value of the first feedback control value (OXFB) based on the second feedback control learning value (SOXFLAV).

Figure 28:
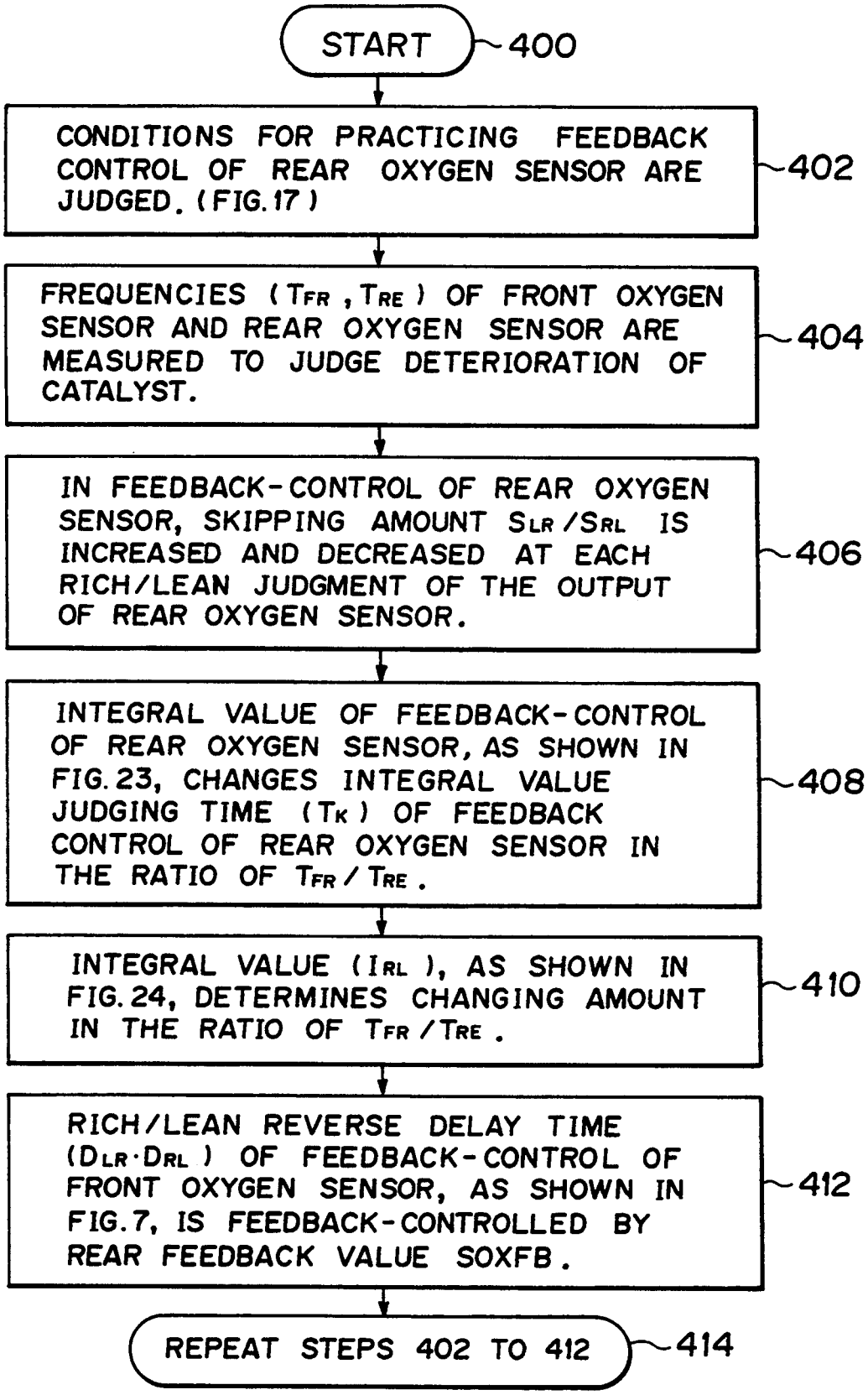
FIG. 28 is a flow chart for controlling an air-fuel ratio control device for an internal combustion engine according to a third embodiment of the invention.

Reference is now made to a third embodiment of the invention which relates to the control flow chart of FIG. 28 for use on the air-fuel ratio control of FIG. 1, as described in conjunction with others of the aforementioned drawings.

The control means 68 (FIG. 1) is, as described above, connected with the front oxygen sensor 86 as a front exhaust sensor for detecting density of oxygen as an exhaust component value disposed at the exhaust passage 6 of the upstream side of the catalyst converter 24, and the feedback-control is effected such that the air-fuel ratio of the air-fuel mixture becomes the target value by adjusting the fuel quantity and/or air quantity based on the oxygen density as the exhaust component value which is detected by the front oxygen sensor 86.

The rear oxygen sensor 88 as a rear exhaust sensor is connected to the control means 68.

The control means 68 is operated to find, when the air-fuel ratio is feedback-controlled, a feedback controlling integral value judging time of the rear exhaust sensor 88 based both on the detection value indicating the output state of the front oxygen sensor 86 and another detection value indicating the output state of the rear oxygen sensor 88 which is changed in accordance with deterioration of the catalyst converter 24, and to find an integral amount. Based on the integral value judging time and the integrated value, the air-fuel feedback-control of the air fuel ratio is effected in accordance with deterioration of the catalyst converter 24.

More specifically, the conditions for practicing the rear oxygen sensor 86 by the control portion 68 are to satisfy, as shown in FIG. 17, all of the following (1) to (5).

(1) The feedback-control of the front oxygen sensor 86 is undergoing.

(2) Idling is not undergoing.

(3) Warming up of the internal combustion engine 2 is finished.

(4) The front oxygen sensor 86 is not subjected to failure.

(5) The rear oxygen sensor 88 is not subjected to failure.

The detection value indicating the output state of the front oxygen sensor 86 comprises, as shown in FIG. 2, a cyclic time or frequency, for example ($T_{FR}$), of the front oxygen sensor 86.

Similarly, the detection value indicating the output state of the rear oxygen sensor 88 comprises, as shown in FIGS. 3 and 4, a cyclic time or frequency, for example, ($T_{RE}$), of the rear oxygen sensor 88.

Referring to the ratio between the frequency ($T_{FR}$) of the front oxygen sensor 86 and the frequency ($T_{RE}$) of the rear oxygen sensor 88, the integral value judging time $t_k$ is found as shown in FIG. 23, and the integral value ($I_{RL}$) is found as shown in FIG. 24. Then, the air-fuel ratio is feedback-controlled based on the integral value judging time $t_k$ and the integral value ($I_{RL}$).

As for the movement of the rear feedback value (SOXFB) of the rear oxygen sensor 88, the skipping amount ($S_{LR}$, $S_{RL}$) is generated at each rich/lean judgment of the rear oxygen sensor 88, and the integral value ($I_{RL}$) is generated at each passage of the integral value judging time $t_k$ in the rich/lean duration time $T_R/T_L$ of the output of the rear oxygen sensor 86.

The frequency ($T_{RE}$) of the rear oxygen sensor 88 is changed in accordance with deterioration of the catalyst converter 24, and the integral value judging time $t_k$ and the integral value ($I_{RL}$), which are found with reference to the ratio, i.e., ($T_{FR}$, $T_{RE}$), between the frequency ($T_{FR}$) of the front oxygen sensor 86 and the frequency ($T_{RE}$) of the rear oxygen sensor 88, can be changed in accordance with deterioration of the catalyst converter 24. As a result, the feedback-control of the air-fuel ratio can be effected by the control portion 68 in accordance with deterioration of the catalyst converter 24.

Figure 7:
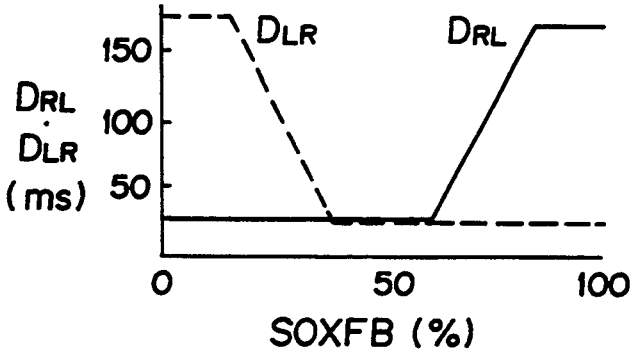
FIG. 7 PRIOR ART
FIG. 7 is a view showing the relation between a second feedback control value (SOXFB) and an air-fuel ratio reverse delay time ($D_{LR}$, $D_{RL}$) of a first feedback control value (OXFB), according to the prior art.

Furthermore, the front oxygen sensor 86 is controlled by the rear feedback value (SOXFB) shown in FIG. 7 such that the center of the feedback-control on the front side satisfies $\alpha=1$.

Next, operation will be described with reference to the control flow chart of FIG. 28.

When the internal combustion engine 2 is started, a control program is started at Step 400. Then, it is judged at Step 402 whether or not the conditions for effecting feedback control from the rear sensor, i.e., all of the conditions indicated in FIG. 17, are satisfied.

If it is judged at Step 402 that all of the conditions of FIG. 17 are satisfied, then the conditions for effecting feedback of the rear oxygen sensor is satisfied, and the frequencies ($T_{FR}$, $T_{RE}$) with respect to the front oxygen sensor and the rear oxygen sensor are measured, respectively, in order to judge at Step 404 the deterioration of the catalyst converter.

After the judgment at Step 404, as a part of the procedure of the feedback-control of the rear oxygen sensor, the skipping amount ($S_{LR}$, $S_{RL}$) is added or subtracted at Step 406 at each rich/lean judgment of the output of the rear oxygen sensor.

And, as shown in FIG. 24, the changing amount of the integral value ($I_{RL}$) is determined (Step 410) by the ratio of ($T_{FR}$, $T_{RE}$).

The rich/lean reverse delay time ($D_{LR}$, $D_{RL}$) of the feedback-control of the front oxygen sensor, as shown in FIG. 7, is feedback-controlled (Step 412) by the rear feedback value (SOXFB) (%).

After the procedure of Step 412, the operation of Step 414 then returns and repeats Steps 402 to 412.

By this, the feedback-control of the rear .oxygen sensor can be effected in accordance with deterioration of the catalyst converter. There is no fear that when a new catalyst converter is used, the feedback-control of the rear oxygen sensor is extensively effected, and the center of the feedback control on the front side can be controlled to $\alpha=1$.

When the deteriorated catalyst converter is used, since the integral value judging time $t_k$ can be set in accord with the frequency ($T_{RE}$) of the rear oxygen sensor, the center of the feedback-control on the front side can still be controlled to $\alpha=1$.

Furthermore, since the integral value ($I_{RL}$) can be changed in accordance with deterioration of the catalyst converter, an action corresponding to deterioration of the catalyst converter can be realized, and the center of the feedback-control on the front side can accurately be controlled to $\alpha=1$.

The present invention is not limited to the above embodiment, but can be modified into various forms. For example, in this embodiment of the invention, the frequency ($T_{FR}$) of the front oxygen sensor is used as the detection value indicating the output state of the front oxygen sensor, and the frequency ($T_{RE}$) of the rear oxygen sensor is used as the detection value indicating the output state of the rear oxygen sensor. However, it may be any others as long as the deteriorating state of the catalyst converter can be determined. The cycle time of the front and rear oxygen sensors and others can be used for the frequencies ($T_{FR}$, $T_{RE}$).

EMBODIMENT OF FIGS. 29–54

In some air-fuel ratio control devices the air-fuel ratio is controlled by adjusting an injection quantity as a fuel quantity which is to be supplied to the internal combustion engine in accordance with signals from various sensors for detecting a driving mode of the internal combustion engine, such as a throttle aperture sensor, an engine speed sensor, etc.

More specifically, in a air-fuel ratio control device of the type mentioned above, a front $O_2$ sensor as a first exhaust sensor is disposed at an exhaust passage on an upstream side of a catalytic member which is disposed at an intermediate portion of the exhaust passage of the internal combustion engine, a rear $O_2$ sensor being disposed at the exhaust passage on a downstream side of the catalytic member, the air-fuel ratio being first feedback controlled in a steady driving mode of the internal combustion engine in accordance with a first detection signal from the front $O_2$ sensor, the air-fuel ratio being open controlled when the internal combustion engine is in an accelerating/decelerating driving mode other than the steady driving mode, the air-fuel ratio being second feedback controlled in accordance with a second detection signal from the rear $O_2$ sensor and a learned value being calculated by learning the second feedback control when the conditions for effecting the second feedback control are established, the air-fuel ratio being open controlled when the conditions are those other than for effecting the second feedback control.

Figure 48:
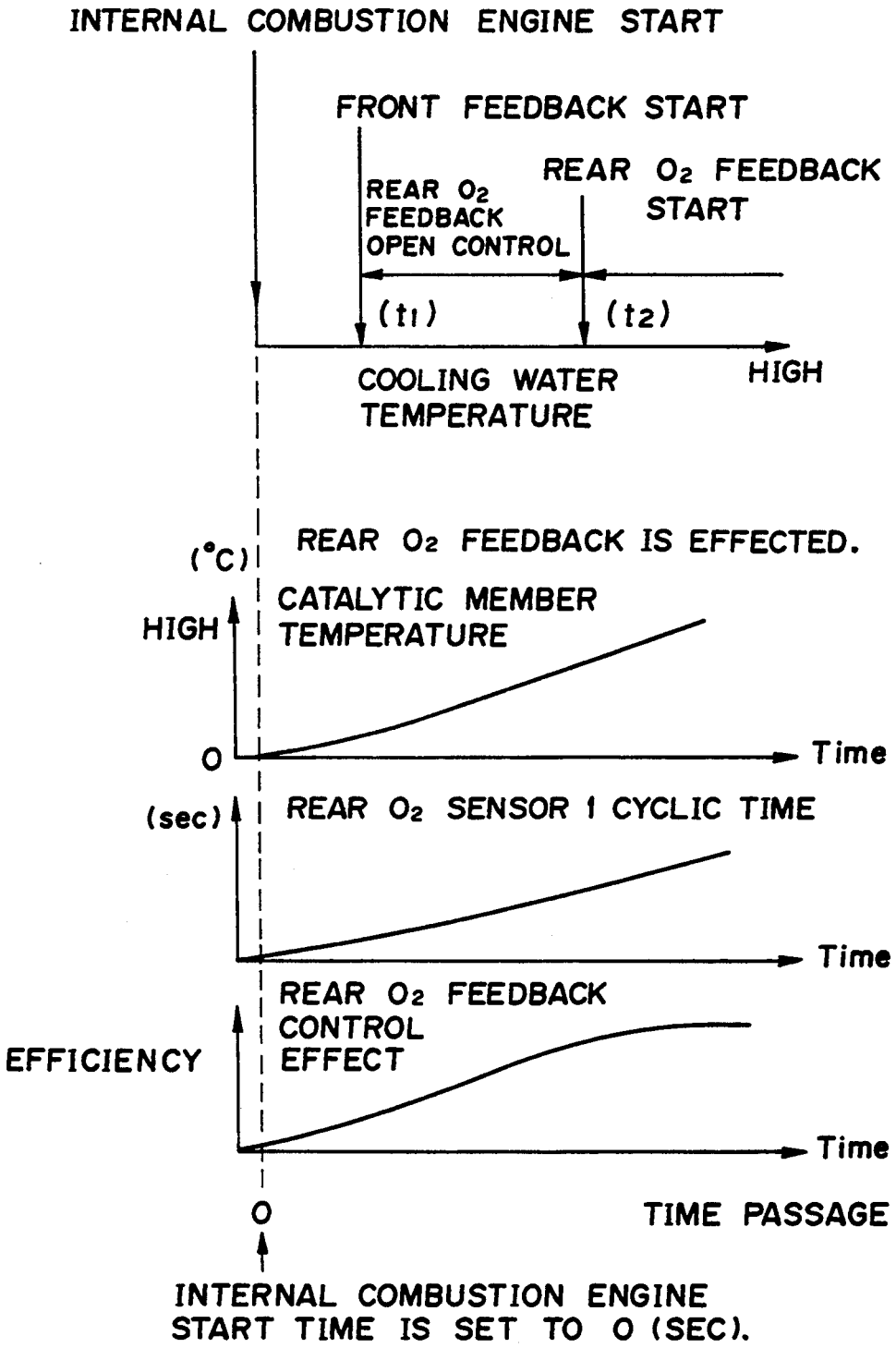
FIG. 48 is a time chart showing the result of the second feedback control by the rear $O_2$ sensor in the prior art.
Figure 49:
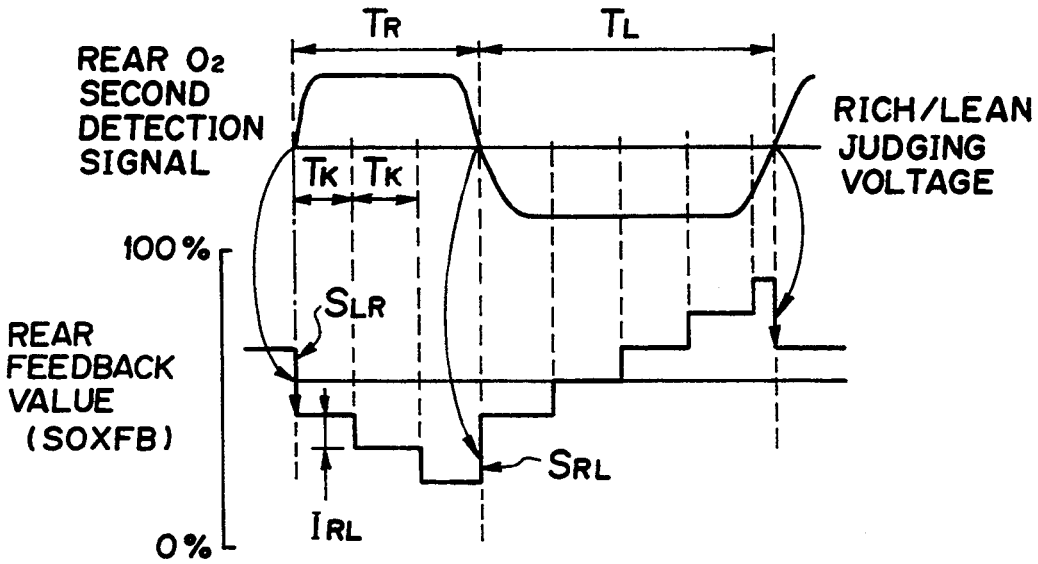
FIG. 49 is a time chart of the second detection signal from a conventional rear $O_2$ sensor.

In such an air-fuel ratio control in accordance with the detection signals from two $O_2$ sensors, respectively, as shown in FIG. 48, a control value of the second feedback control is skip controlled ($S_{RL}$, $S_{LR}$) at every reverse of rich/lean signal as a second detection signal from the rear $O_2$, and an integral value ($I_{RL}$) of the second feedback control is judged for correction with reference to the continued time of the rich signal/lean signal at every passage of a predetermined time $T_K$ as an integral correction judging time.

Figure 50:
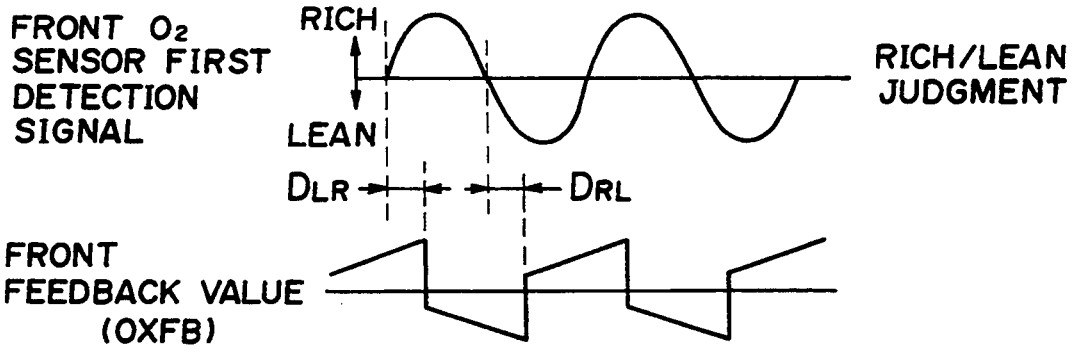
FIG. 50 is a time chart of the first detection signal from the front $O_2$ sensor as in the prior art.
Figure 51:
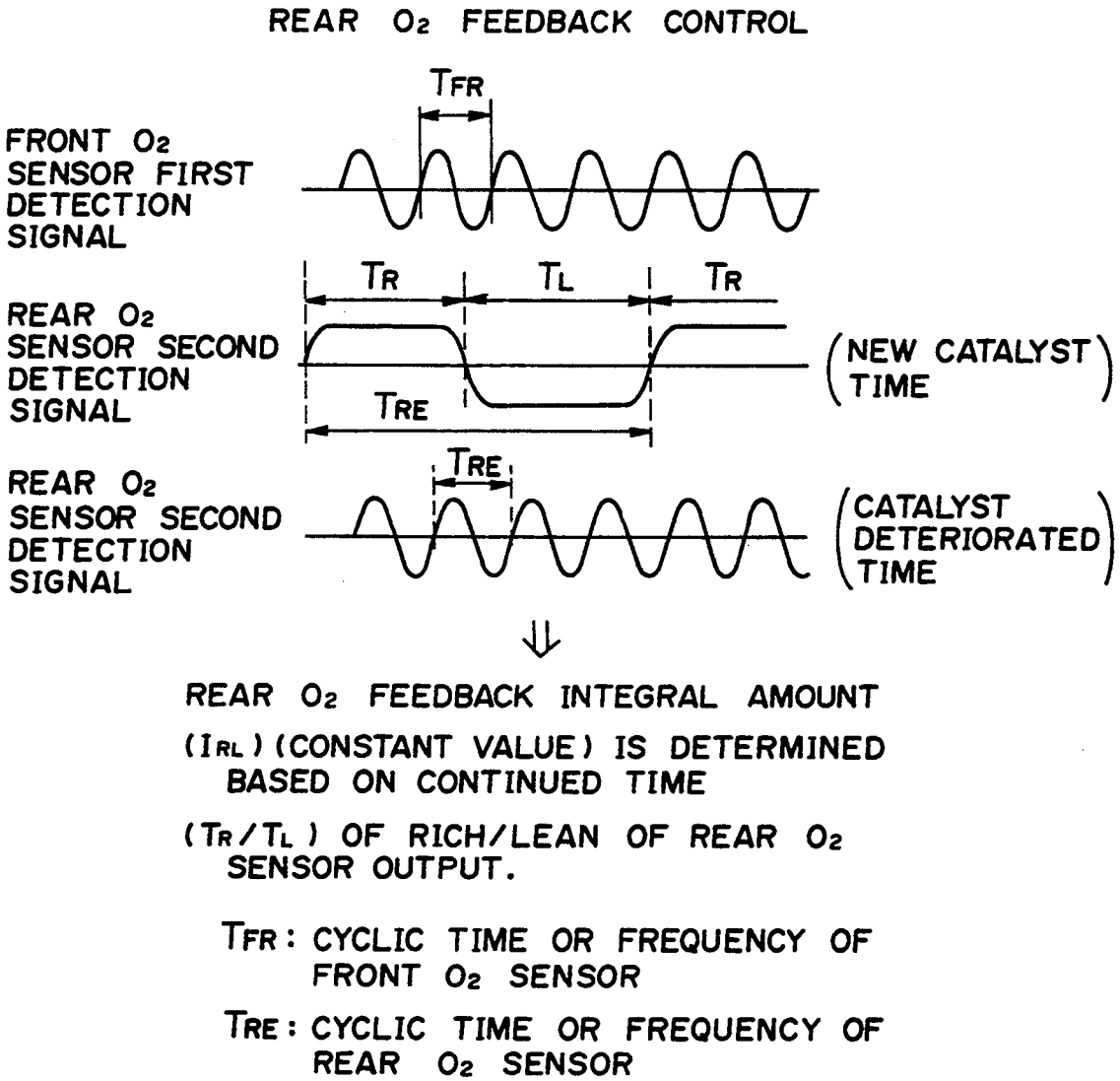
FIG. 51 is a time chart of the feedback control by a conventional rear $O_2$ sensor.
Figure 52:
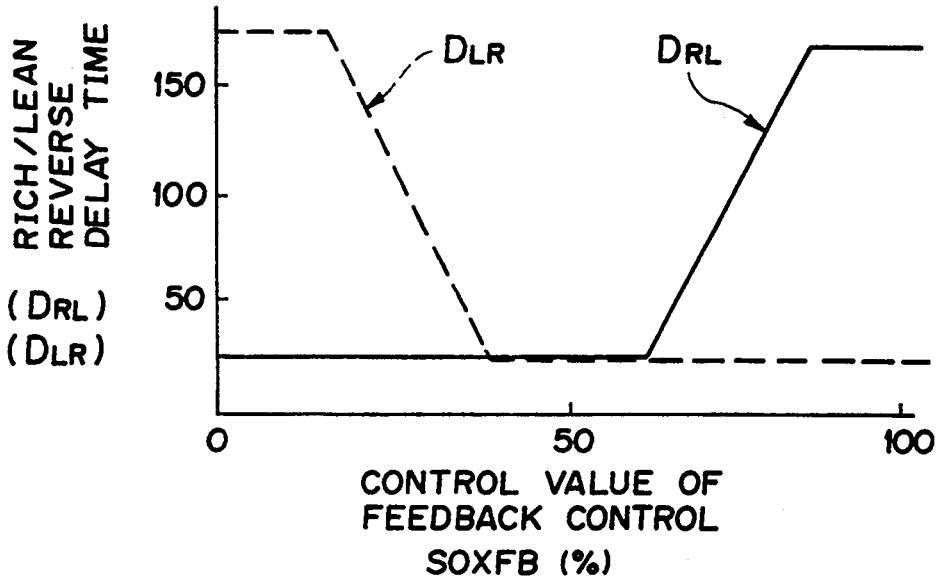
FIG. 52 is a view showing the relation between the conventional feedback control value and the rich/lean reverse delay time.

Also, in the first feedback control in accordance with the first detection signal from the front $O_2$ sensor, the reverse delay time ($D_{LR}$, $D_{RL}$) of the rich signal and/or lean signal reverse delay time ($D_{LR}$, $D_{RL}$) of the rich signal/lean signal as the first detection signal shown in FIG. 50 are feedback controlled, as shown in FIGS. 51 and 52, in accordance with the control value (OXFB) of the first feedback control.

In FIG. 51, in the case where the catalytic member is new, a synchronous time ($T_{FR}$) of the first detection signal of the front $O_2$ sensor is different from a synchronous time ($T_{RE}$) of the second detection signal from the rear $O_2$ sensor. However, it is apparent that when the catalytic member is deteriorated, the synchronous time of the second detection signal from the rear $O_2$ sensor approaches the synchronous time of the first detection signal. The integral value (amount) of the feedback control effected by the rear $O_2$ sensor is a constant value, and is determined by the continued time ($T_R$, $T_L$) of the rich signal/lean signal as the second detection signal from the rear $O_2$ sensor.

In FIG. 52, the lean-rich reverse delay time ($D_{LR}$) is shown by broken lines, and the rich-lean reverse delay time ($D_{RL}$) is shown by a solid line.

Figure 53:
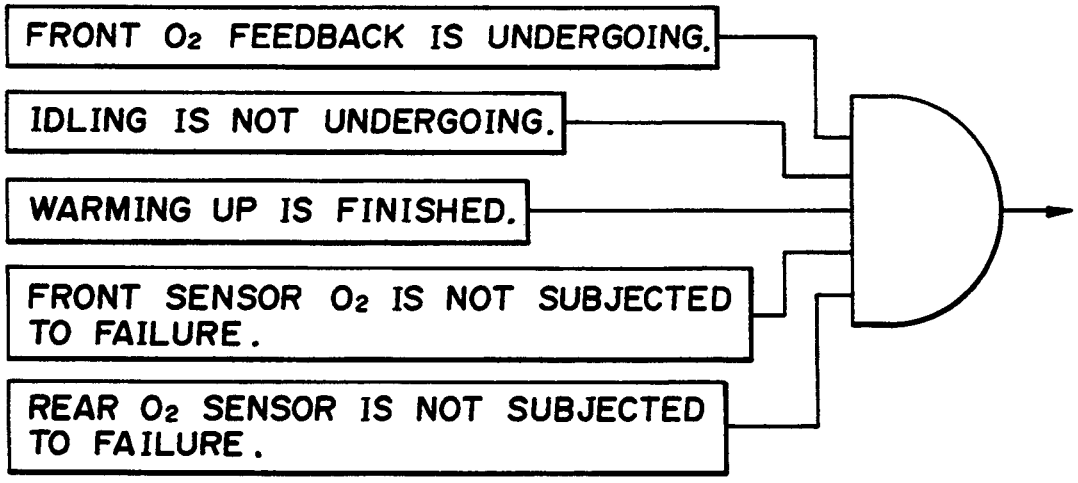
FIG. 53 is an explanatory view of the conditions for effecting the second feedback control by the conventional rear $O_2$ sensor.

The conditions for effecting the second feedback control in accordance with the second detection signal from the rear $O_2$ sensor are met, as shown in FIG. 53, when all the conditions that the feedback control in accordance with the first detection signal from the front $O_2$ sensor is undergoing, that the internal combustion engine is in a state where idling is not undergoing, that a warming-up driving mode of the internal combustion engine is finished, that the front $O_2$ sensor is not subjected to failure, and that the rear $O_2$ sensor is not subjected to failure, are satisfied.

One example of an air-fuel control device equipped with two $O_2$ sensors is disclosed, for example, in Japanese Patent Early Laid-Open Publication No. Sho 61-237858. The device disclosed in this Publication comprises $O_2$ sensors located on an upstream side and a downstream side of a catalyst converter, respectively, such that (1) when the temperature of an element of the $O_2$ sensor is less than a predetermined value, an air-fuel ratio adjustment corresponding to the downstream side $O_2$ sensor in an air-fuel ratio adjustment means is stopped, and (2) when the temperature of the catalyst converter is less than a predetermined value, an air-fuel ratio adjustment corresponding to output of the downstream side $O_2$ sensor is stopped, and (3) when the temperature of exhaust is less than a predetermined value, an air-fuel adjustment corresponding to output of the downstream side $O_2$ sensor is stopped, and (4) when the temperature of a cooling water is less than a predetermined value, an air-fuel adjustment corresponding to output of the downstream side $O_2$ sensor is stopped, thereby directly or indirectly detecting the temperature of an element of the downstream side $O_2$ sensor in order to judge whether or not it is active or non-active.

Heretofore, in the feedback control of the air-fuel ratio in accordance with the detection signals from two $O_2$ sensors, respectively, when the conditions for effecting the second feedback control in accordance with the second detection signal from the rear $O_2$ sensor are realized, the feedback control by the rear $O_2$ sensor is effected in a driving mode other than the steady driving mode such as an acceleration/deceleration driving mode, etc. Accordingly, a feedback control is effected by an amount of correction at the first feedback control by the front $O_2$ sensor even in accordance with the rich signal/lean signal from the rear $O_2$ sensor at the acceleration/deceleration driving mode, and therefore, the air-fuel ratio is wastefully fluctuated to increase generation of a harmful exhaust component.

Figure 54:
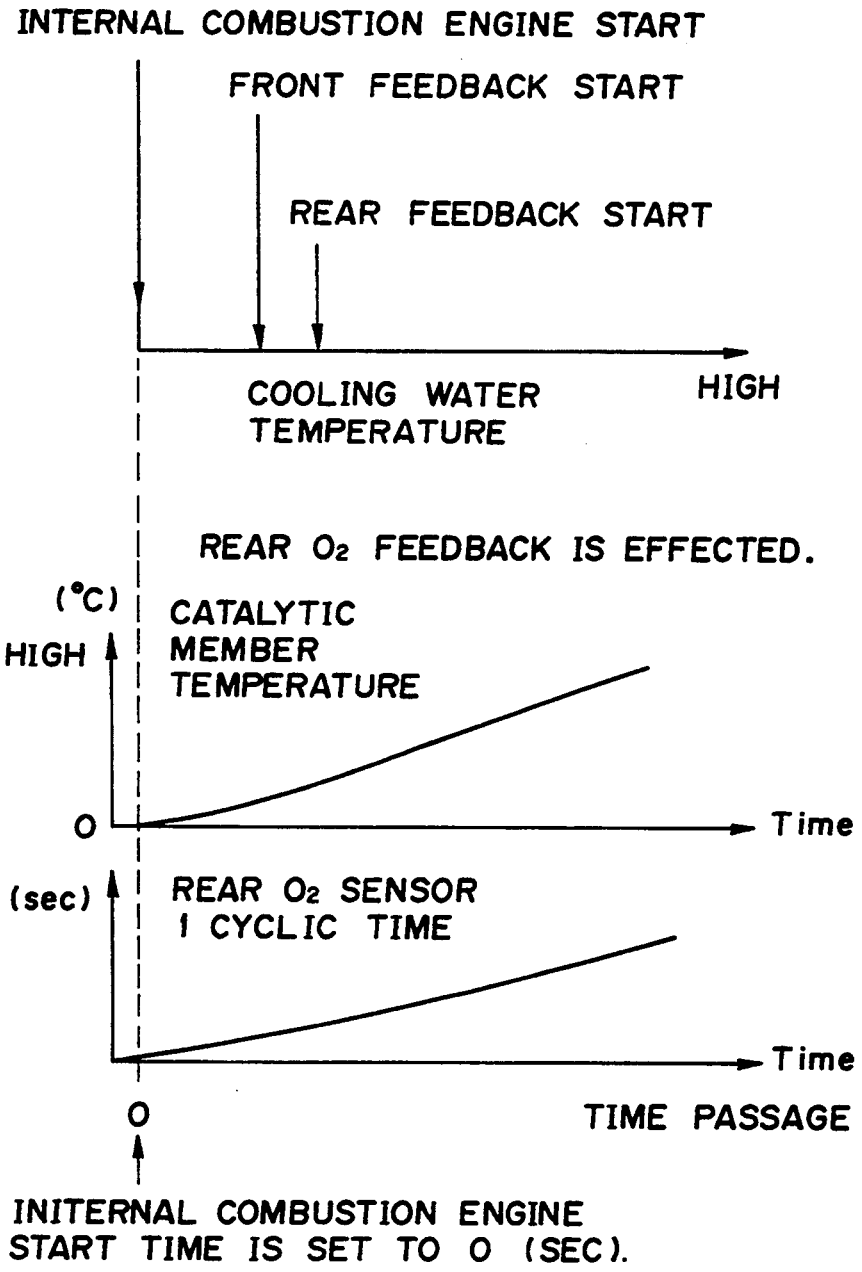
FIG. 54 is a time chart for the case where the second feedback control is started at a low temperature in the prior art and the case where the conventional second feedback control is started at a low temperature.

As shown in FIG. 54, if the second feedback control is started in accordance with the second detection signal from the front $O_2$ sensor after the feedback control in accordance with the first detection signal from the rear $O_2$ sensor when the cooling water temperature is low, the second feedback control in accordance with the second detection signal from the rear $O_2$ sensor is low in effect for restraining the harmful exhaust component by the second feedback control in accordance with the second detection signal from the rear $O_2$ sensor. Accordingly, during the time from the start of the first feedback control in accordance with the first detection signal from the front $O_2$ sensor until the start of the second feedback control in accordance with the rear $O_2$ sensor, the air-fuel ratio in the steady driving mode is difficult to be maintained to a logical air-fuel ratio in the steady driving mode, and the air-fuel ratio is wastefully fluctuated to increase the generation of the harmful exhaust component.

In order to obviate the above-mentioned inconveniences, according to this embodiment of the present invention, there is provided an air-fuel ratio control device for an internal combustion engine comprising exhaust sensors each disposed on an upstream side and a downstream side of a catalytic member, the air-fuel ratio control device for an internal combustion engine further comprising control means for stopping the second feedback control according to the second detection signal of the second exhaust sensor even if the conditions for effecting the second feedback control are met with the air-fuel ratio is open controlled in accordance with the first detection signal from the first exhaust sensor, and for correcting the first feedback controlling state based on the learned value of the second feedback control during a period from the start of the first feedback control in accordance with the first detection signal from the first exhaust sensor until the start of the second feedback control in accordance with the sensor detection signal from the second exhaust sensor.

According to a function of this latter embodiment of the invention, the second feedback control according to the second detection signal of the second exhaust sensor is stopped even if the conditions for effecting the second feedback control are met when the air-fuel ratio is open controlled in accordance with the first detection signal from the first exhaust sensor, and the first feedback controlling state is corrected based on the learned value of the second feedback control during a period from the start of the first feedback control in accordance with the first detection signal from the first exhaust sensor until the start of the second feedback control in accordance with the second detection signal from the second exhaust sensor. By this, a first feedback control in accordance with a first detection signal from a first exhaust sensor is stopped for unstable factor such as accelerating or decelerating driving mode of the internal combustion engine, and the air-fuel ratio in a steady driving mode is stably maintained to the logical air-fuel ratio, thereby reducing generation of harmful exhaust component. Furthermore, the air-fuel ratio based on a learned value of the second feedback control is controlled during a period from the start of the first feedback control in accordance with the first detection signal from the first exhaust sensor until the start of the second feedback control in accordance with the second detection signal from the second exhaust sensor, thereby accurately controlling the air-fuel ratio at a steady driving mode to a logical air-fuel ratio in order to reduce generation of harmful exhaust component.

This embodiment of the invention will now be described with reference to FIGS. 29 through 48.

Figure 29:
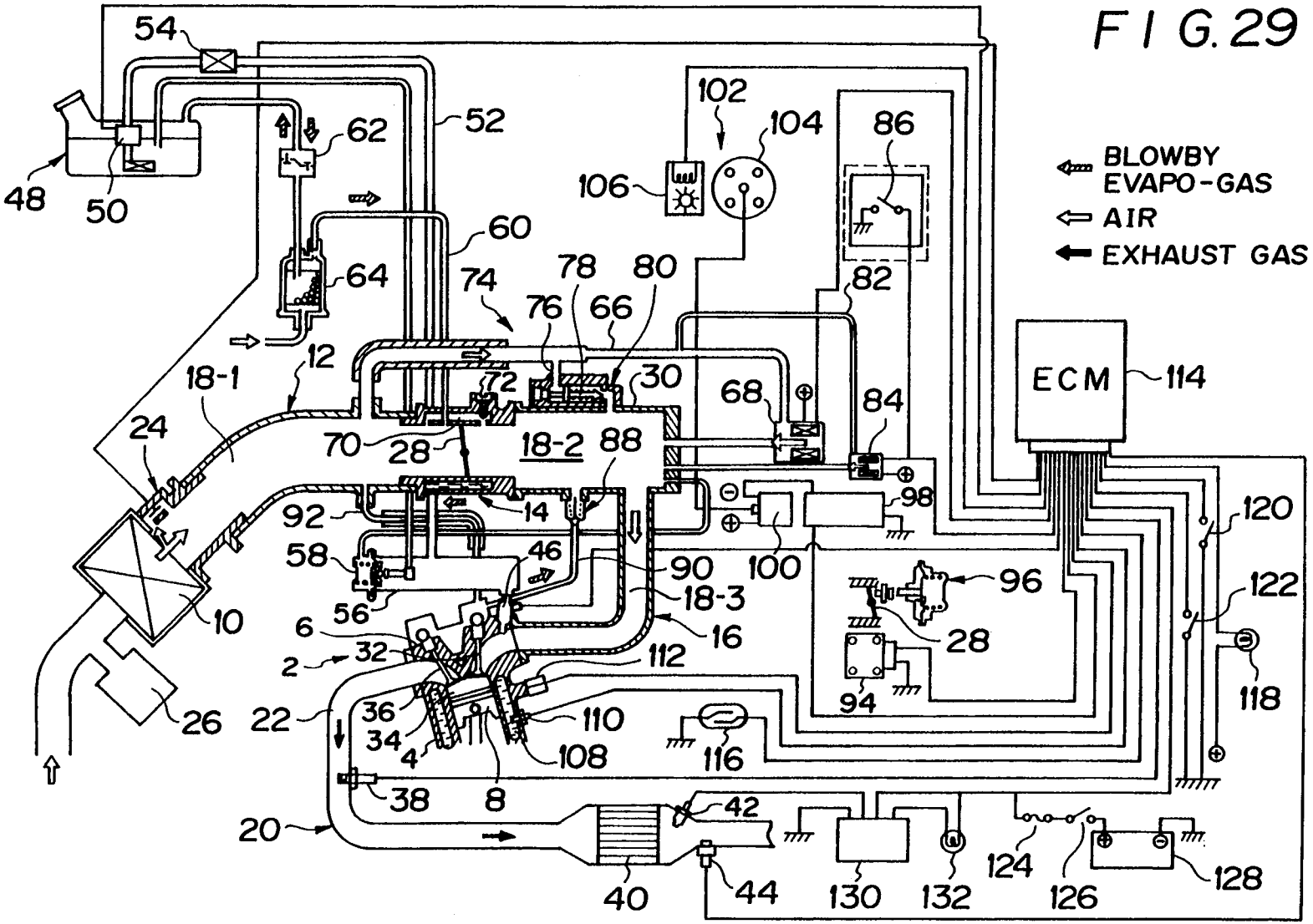
FIG. 29 is a view showing a construction of a system of an air-fuel ratio control device for an internal combustion engine according to a fourth embodiment of the invention.

In FIG. 29, numeral 502 denotes an internal combustion engine including an air-fuel ratio control device for an electronic control type fuel injection system, 504 a cylinder block, 506 a cylinder head, 508 a piston, 510 an air cleaner, 512 an intake pipe, 514 a throttle body, 516 an intake manifold, 518 an intake passage, 520 an exhaust pipe, and 522 an exhaust passage.

An air flowmeter 524 for measuring an amount of intake air is located on an upstream side of the intake pipe 512 which forms a first intake passage 518-1 interposed between the air cleaner and the throttle body 514.

A resonator 526 for lowering an intake air sound is located on an upstream side of the air cleaner 510. An inlet throttle valve 528 is disposed within a second intake passage 518-2 communicating with the first intake passage 518-1 which is formed in the throttle body 514. This second intake passage 518-2 is communicated with a third intake passage 518-3 which is formed in the intake manifold 516 through a surge tank 530. A downstream side of this third intake passage 518-3 is communicated with a combustion chamber 534 of the internal combustion engine 502 through an inlet valve 532. This combustion chamber 534 is communicated with the exhaust passage 522 through the outlet value 536.

A front $O_2$ sensor 538 as a first exhaust sensor with a heater, a catalytic member 540, and a thermo-fuse 542 are arranged at the exhaust pipe 520 in this order from the internal combustion engine 502 side. The front $O_2$ sensor 538 is disposed at the exhaust passage 522 on the upstream side of the catalytic member 540, and adapted to detect the concentration of oxygen and to output a first detection signal.

A rear $O_2$ sensor 544 as a second exhaust sensor is disposed at the exhaust passage 522 on the downstream side of the catalytic member 540. This rear $O_2$ sensor 544 is adapted to detect the concentration of oxygen within the exhaust passage on the downstream side of the catalytic member 540 and to output a second detection signal.

A fuel injection value 546 directing toward the combustion chamber 534 is mounted on an area of connection between the intake manifold 516 and the cylinder head 506.

Fuel within a fuel tank 548 is fed to this fuel injection valve 546 under pressure. Specifically, the fuel within the fuel tank 548 is fed to a fuel supply passage 552 by a fuel pump 550 under pressure, then brought a fuel distribution pipe 556 after being filtrated by a fuel filter 554, and then fed to the fuel injection valve 546 after being regulated to a constant level in pressure by a fuel pressure regulator 558.

An evaporation fuel passage 560, which is communicated at one end thereof with an upper portion within the fuel tank 548, is communicated at the other end with the second intake passage 518-2 of the throttle body 514. Disposed at an intermediate portion of this evaporation fuel passage 560, are a two-way valve 562, and a canister 564 arranged in this order from the fuel tank 548 side.

In order to intercommunicate the first intake passage 518-1 and the interior of the surge tank 530, a bypass air passage 566 is disposed in such a manner as to go around the inlet throttle valve 528. This bypass air passage 566 is provided with an idle speed control value (ISC valve) 568 adapted to regulate the quantity of bypass air by opening and closing the bypass air passage 566.

The throttle valve 514 has an auxiliary bypass air passage 570 formed therein in such a manner as to go around the inlet throttle valve 528. This auxiliary bypass air passage 570 is opened and closed by an auxiliary bypass air quantity adjusting instrument 572.

The auxiliary bypass air passage 570, the idle speed control valve 568, and the auxiliary bypass air quantity adjusting instrument 572 all together constitute an idle speed control device 574.

In this idle speed control device 574, the idle speed of the internal combustion engine 502 is feedback controlled to a target idle speed by the idle speed control valve 568, and the target idle speed is adjusted by the auxiliary bypass air quantity adjusting instrument 572 which is provided at the auxiliary bypass air passage 570 which is served to interconnect the first intake passage 518-1 and the interior of the surge tank 530 in such a manner as to go around the inlet throttle valve 528.

An air passage 576 is branched from an intermediate portion of the bypass air passage 564 and adapted to communicate with the interior of the surge tank 530. This air passage 576 is provided with an air valve 578 which is actuated by temperature of engine cooling water, etc. Both the air passage 574 and the air valve 576 constitute an air regulator 580.

A power stay air passage 582 is branched from an intermediate portion of the bypass air passage 566 and adapted to communicate with the interior of the surge tank 530. This power stay air passage 582 is provided with a power stay control value 584. This power stay control value 584 is actuated and controlled by the power stay switch 586.

In order to circulate a blowby gas, which is generated in the internal combustion engine 502, back to an intake system, a first blowby gas flow-back passage 590 communicating with a PCV valve 588 mounted on the surge tank 530, and a second blowby gas flow-back passage 592 communicating with the first intake passage 518-1, are communicated with the cylinder head 506 of the internal combustion engine 502.

There is provided a throttle sensor 594 in order to detect an opening state of the inlet throttle valve 528, and there is also provided a dash pot 596 in order to prevent an abrupt closing of the inlet throttle valve 528.

On the other hand, an ignition coil 600 communicating with a power unit 598 is communicated with a distributor 604 which constitutes an ignition mechanism.

There is also provided a crank angle sensor 606 in order to detect a crank angle of the internal combustion engine 502.

The cylinder block 504 of the internal combustion engine 502 is provided with a water temperature sensor 610 for detecting an engine cooling water temperature within a cooling water passage 608 which is formed in this cylinder block 504, and a knock sensor 612 for detecting a knocking state of the internal combustion engine 502.

The air flowmeter 524, the front $O_2$ sensor 538, the rear $O_2$ sensor 544, the fuel injection valve 546, the fuel pump 550, the idle speed control valve 568, the power stay control value 584 and power stay switch 586, the throttle sensor 594, the power unit 598, the crank angle sensor 606, the water temperature sensor 610, and the knock sensor 612 are all in connection with control means (engine control module; ECM) 614.

This control means 614 is in connection with a vehicle speed sensor 616, a diagnosis lamp 618, a diagnosis switch 620, a test switch 622, a battery 628 through a fuse 624 and a main switch 626, and an alarm lamp 632 through an alarm relay 630, respectively. This alarm relay 630 is in connection with the thermo-fuse 542.

The control means 614 is operated to control the internal combustion engine 502 by inputting various detection signals therein from various sensors. Specifically, the air-fuel reaction is first feedback controlled into a steady driving area of the internal combustion engine 502 in accordance with the first detection signal from the first or front $O_2$ sensor 538, the air-fuel ratio being open controlled when the internal combustion engine is in an accelerating/decelerating driving mode (i.e. other than the steady driving mode), the air-fuel ratio being second feedback controlled in accordance with a second detection signal from the rear $O_2$ sensor and a learned value being calculated by learning the second feedback control when the conditions for effecting the second feedback control are established, the air-fuel ratio being open controlled when the conditions are those other than for effecting the second feedback control. Furthermore, even if the conditions for effecting the second feedback control are met when the air-fuel ratio is open controlled in accordance with the first detection signal from the front $O_2$ sensor 538, the second feedback control in accordance with the second detection signal of the rear $O_2$ sensor 544 is stopped in order to open control the air-fuel ratio, and the first feedback controlling state is corrected based on the learned value of the second feedback control during a period from the start of the first feedback control in accordance with the first detection signal from the front $O_2$ sensor 538 until the start of the second feedback control in accordance with the second detection signal from the rear $O_2$ sensor 544.

Next, a function of this embodiment will be described with reference to the flow charts of FIGS. 30 to 33.

Figure 30:
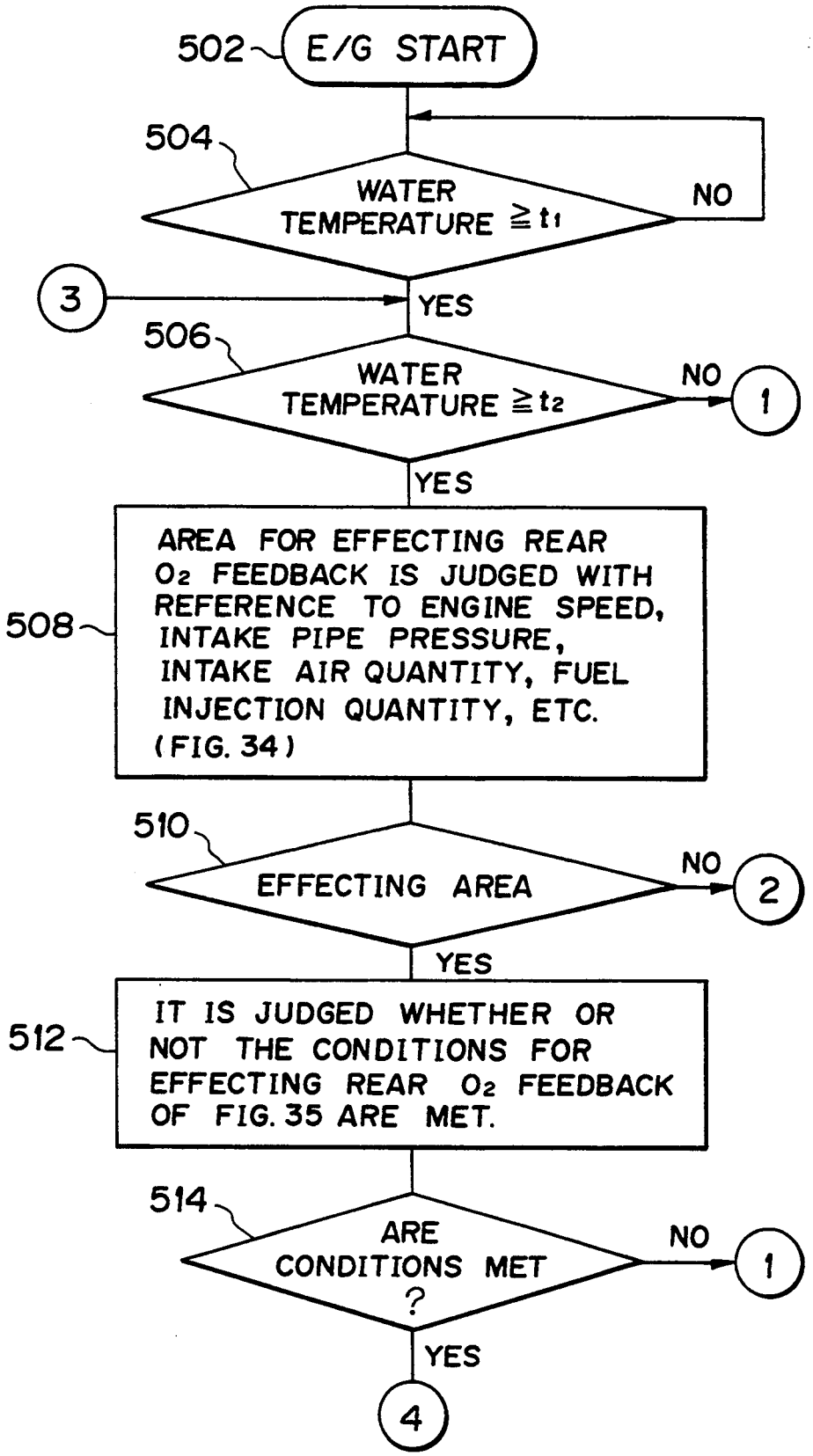
FIG. 30 is a flow chart for explaining the operation of air-fuel control according to the fourth embodiment.

In the control means 614, as shown in FIG. 30, when the internal combustion engine 502 is started, the program is started (Step 702) to first judge whether or not the cooling water temperature is equal to or more than a first predetermined value ($t_1$), i.e., water temperature $\geqq t_1$ (Step 704). If the judgment result in Step 704 is "NO", this judgment is repeated.

If the judgment result in above Step 704 is "YES", it is judged whether or not the cooling water temperature is equal to or more than a second predetermined value ($t_2$), i.e., water temperature $\geqq t_2$ (Step 706).

Figure 34:
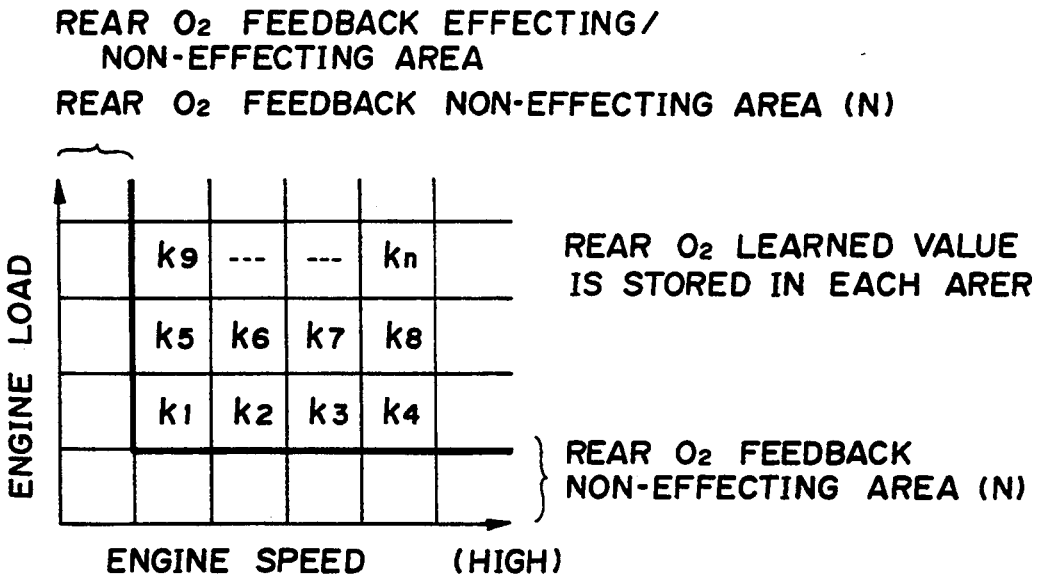
FIG. 34 is a view (i.e. a map) showing relation between an area where the second feedback control is effected by the rear $O_2$ sensor and an area where the second feedback control is not effected by the rear $O_2$ sensor.

If the judgment result in Step 706 is "YES", the requirement for meeting the area for effecting the second feedback control in accordance with the second detection signal from the rear $O_2$ sensor 544 is determined with reference to the engine speed, intake pipe pressure, intake air quantity, fuel injection quantity, etc. (Step 708). In other words, as shown in FIG. 34, in the control means 614, it is judged whether it is the second feedback control effecting area (K) or the second feedback control non-effecting area (N) in a map, for example, for engine speed and engine load, and the second feedback control is learned to store the learned value in each area.

Then, it is judged whether or not it is the second feedback control effecting area (Step 710).

Figure 35:
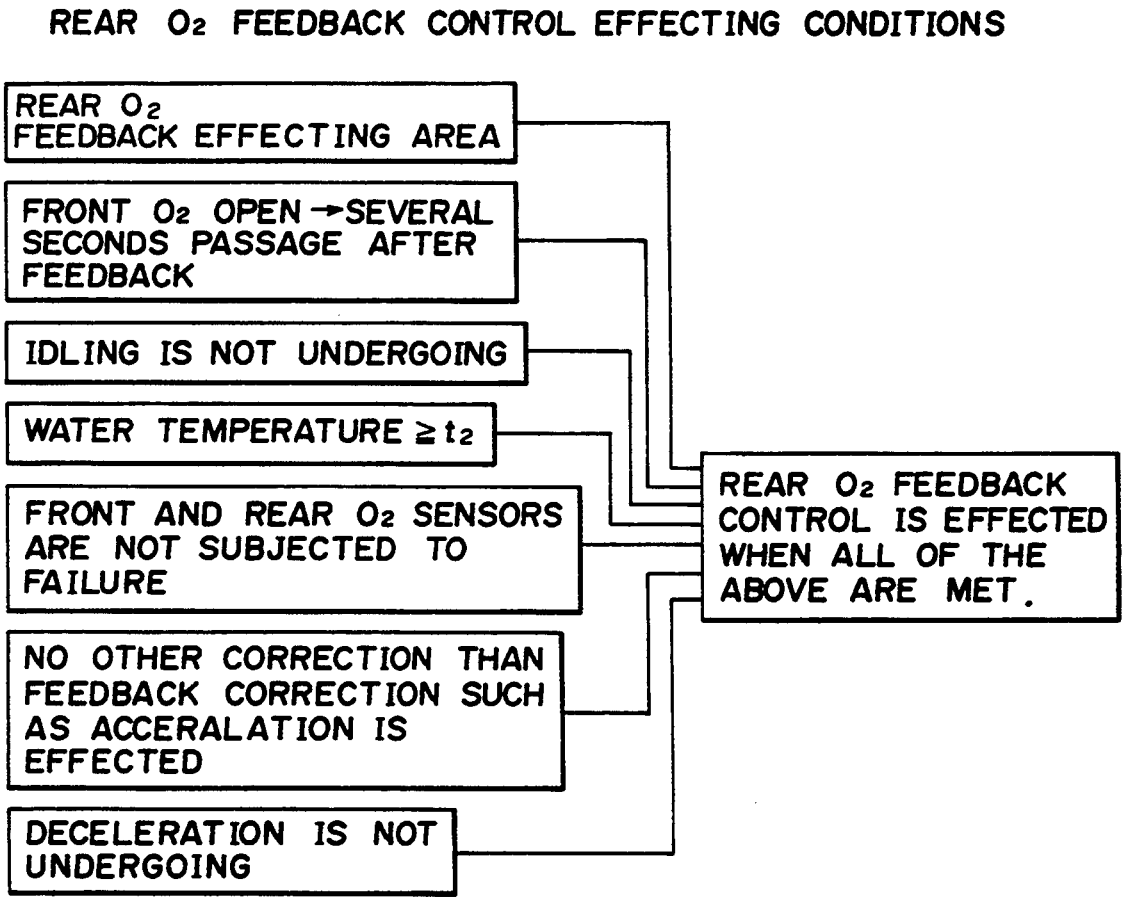
FIG. 35 is an explanatory view showing the conditions for effecting the second feedback control in accordance with the rear $O_2$ sensor.

If the judgment result in Step 710 is "YES", it is judged whether or not the conditions for effecting the second feedback control in FIG. 35 are met (Step 712). The conditions for effecting the second feedback control are met as shown in FIG. 35, when all the conditions that it is within the second feedback effecting area (K) shown in FIG. 34, that a few seconds have passed after the program proceeds from the open control effected by the front $O_2$ sensor 538 to the first feedback control, that the internal combustion engine 502 is in a state where the idling is not undergoing, that the cooling water temperature is equal to or more than the second predetermined value ($t_2$), that the front and rear $O_2$ sensors 538, 544 are not subjected to failure, and that correction in acceleration, etc. other than correction in feedback control is not effected, and that the internal combustion engine 502 is not in a deceleration driving mode, are satisfied. The reason why the second feedback control is effected after a few seconds have passed after the program proceeds to the first feedback control by the front $O_2$ sensor 538, is to increase the lowering effect of the harmful exhaust component by stopping the second feedback control when the cooling water temperature is low.

Then, it is judged whether or not the second feedback control effecting conditions are met (Step 714).

Figure 31:
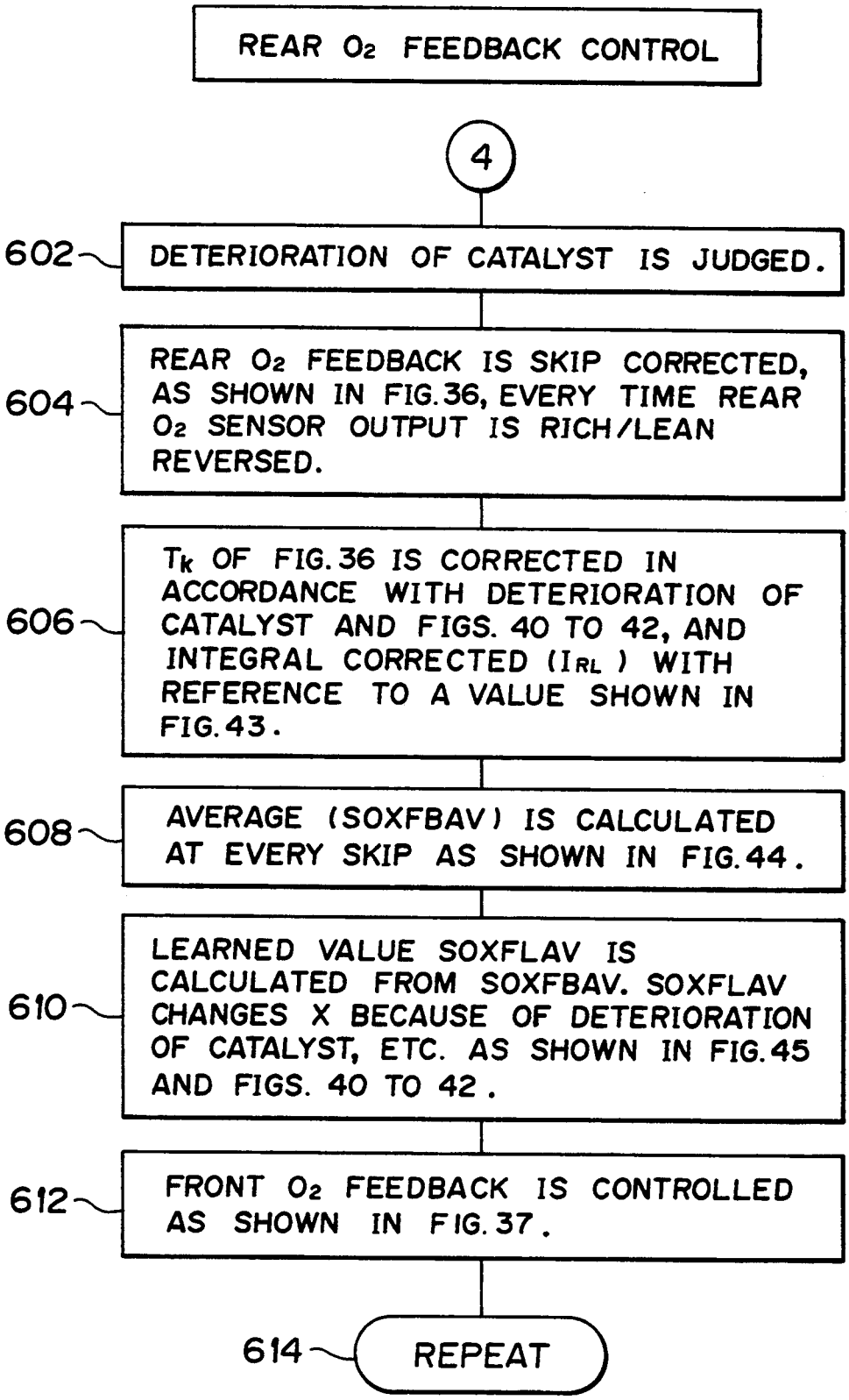
FIG. 31 is a flow chart of second feedback control by a rear $O_2$ sensor.

If the judgment result in Step 714 is "YES", in FIG. 31, the second feedback control is effected in accordance with the second detection signal from the rear $O_2$ sensor 544. In this second feedback control, first, the deteriorating condition of the catalytic member 540 is judged (Step 802) with reference to frequency of the synchronous time ($T_{FR}$) of the first detection signal of the front $O_2$ sensor 538, responding rate, output voltage ratio, etc. And the second feedback control, as shown in FIG. 36, effects the skip correction ($S_{LR}$, $S_{RL}$) every time the rich signal/lean signal from the rear $O_2$ sensor 544 is reversed (Step 804).

Figure 36:
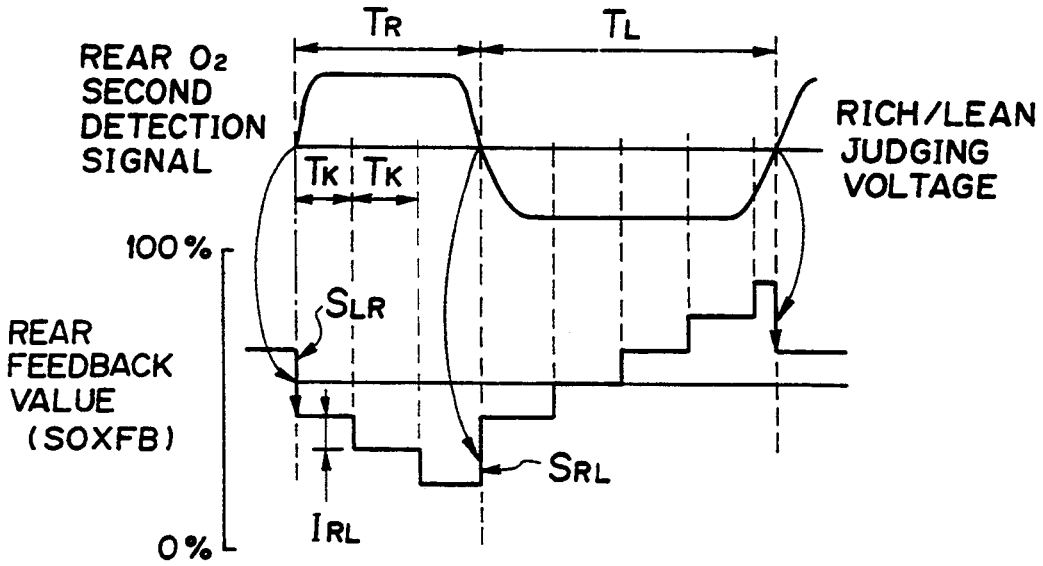
FIG. 36 is a time chart between a second detection signal from the rear $O_2$ sensor and a control value.

That is, as shown in FIG. 36, the control value of the second feedback control is skip corrected ($S_{RL}$, $S_{LR}$), and the integral value ($I_{RL}$) of the second feedback control is judged for correction every time the predetermined $T_K$ as an integral correction judging time is passed, with reference to the continued time of the rich signal/lean signal.

Figure 37:
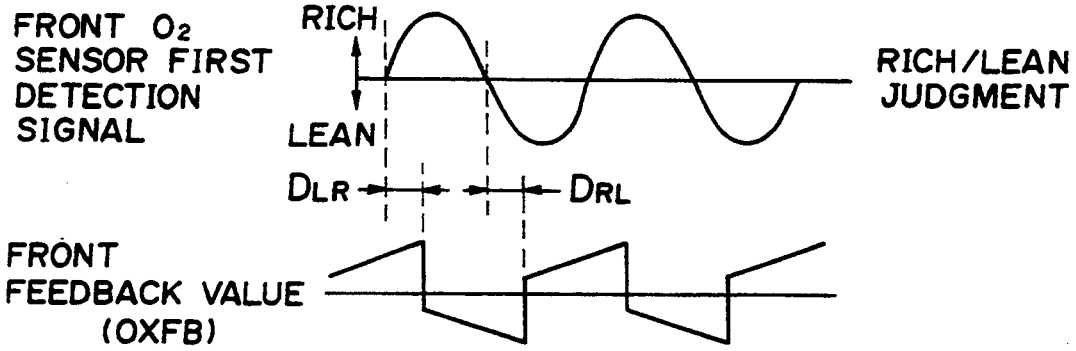
FIG. 37 is a time chart between a first detection signal from the front $O_2$ sensor and the control value.
Figure 38:
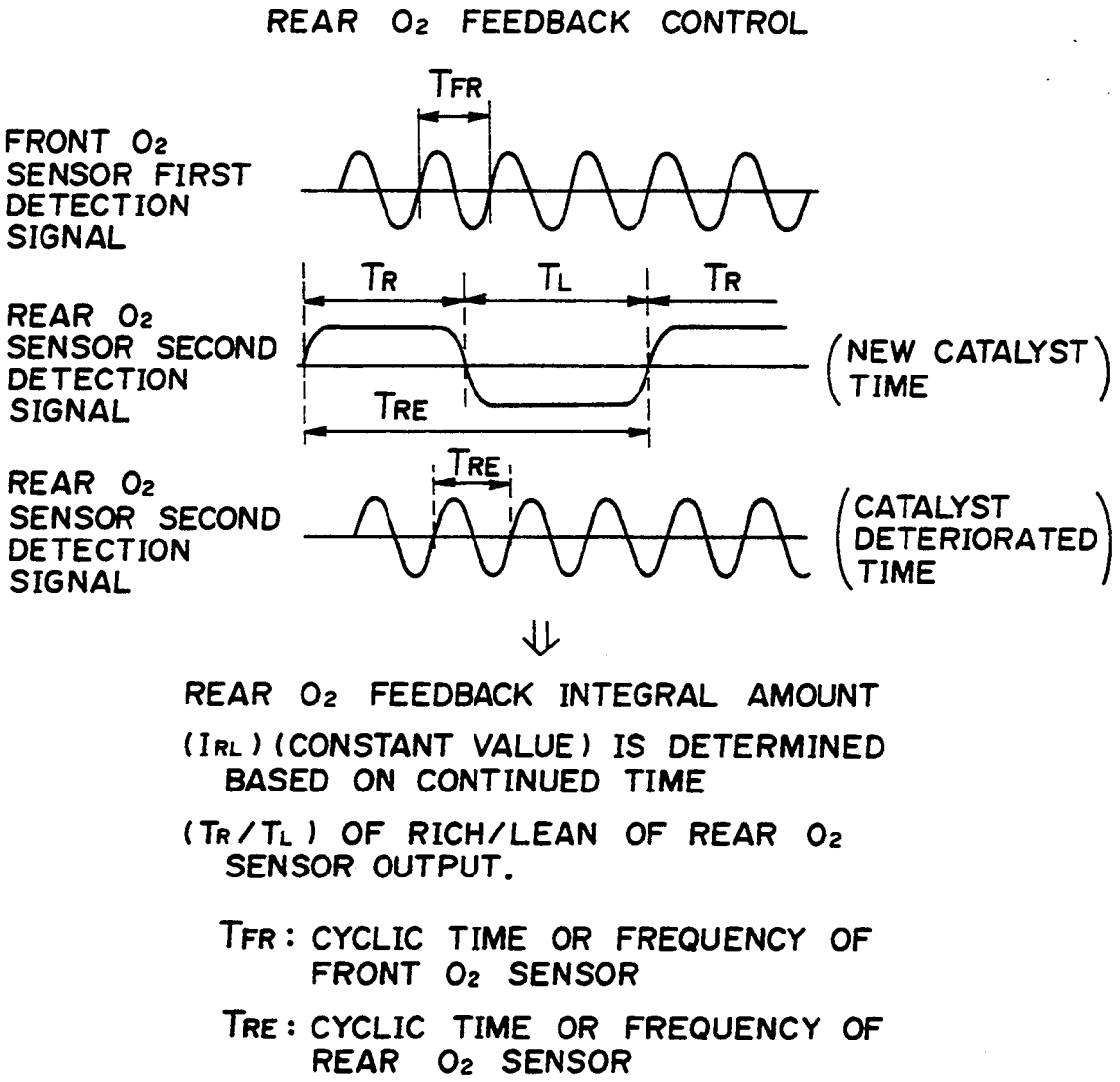
FIG. 38 is a time chart of the second feedback control according to the rear $O_2$ sensor.
Figure 39:
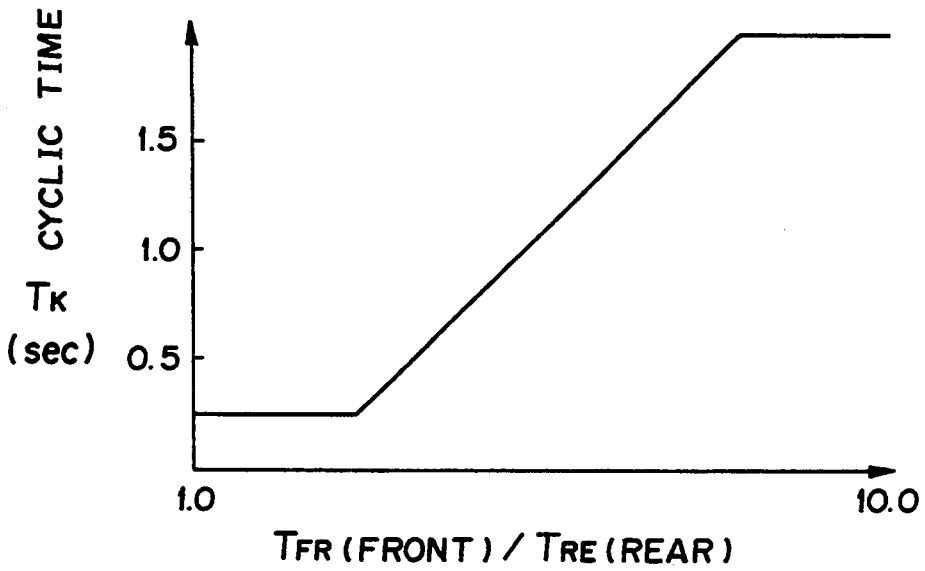
FIG. 39 is an explanatory view showing a deteriorated state of a catalytic member.

In the first feedback control effected in accordance with the first detection signal from the front $O_2$ sensor, the reverse delay time ($D_{LR}$, $D_{RL}$) of the rich signal/-lean signal as the second detection signal shown in FIG. 37 is feedback controlled based on the control value (OXFB) of the first feedback control as shown in FIGS. 38 and 39.

In FIG. 38, in the case where the catalytic member is new, the synchronous time ($T_{FR}$) of the first detection signal from the front $O_2$ sensor 538 is different from the synchronous time ($T_{RE}$) of the second detection signal from the rear $O_2$ sensor 544, but when the catalytic member is deteriorated, it is apparent that the synchronous time ($T_{RE}$) of the second detection signal from the rear $O_2$ sensor 544 approaches the synchronous time ($T_{FR}$) of the first detection signal. Further, the integral value (amount) ($I_{RL}$) of the feedback control effected by the rear $O_2$ sensor 544 is a constant value, and determined by the continued time ($T_R$, $T_L$) of the rich signal/lean signal as the second detection signal from the rear $O_2$ sensor 544.

Figure 40:
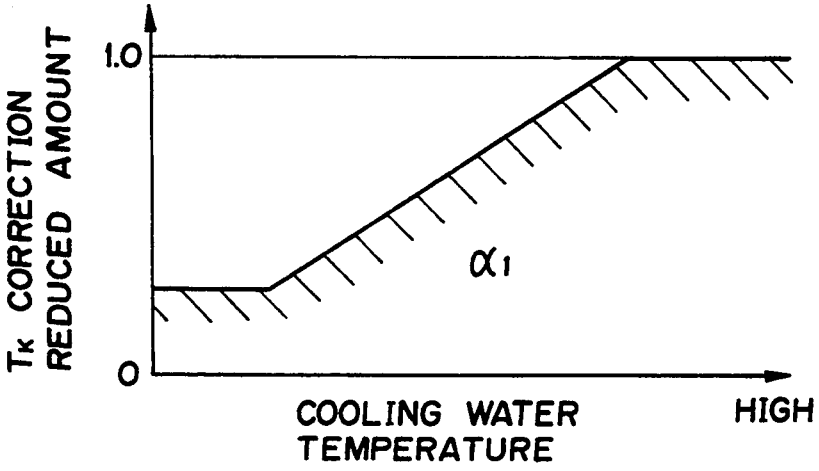
FIG. 40 is a view showing the relation between temperature of cooling water and a reduced amount of correction of $T_K$.
Figure 41:
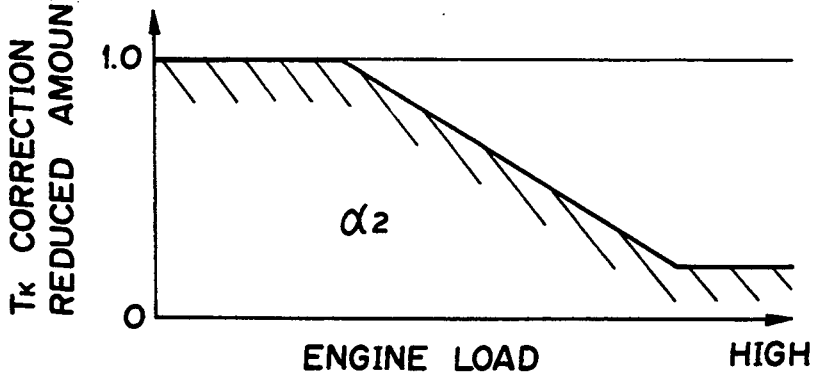
FIG. 41 is a view showing the relation between an engine load and a reduced amount of correction of $T_K$.
Figure 42:
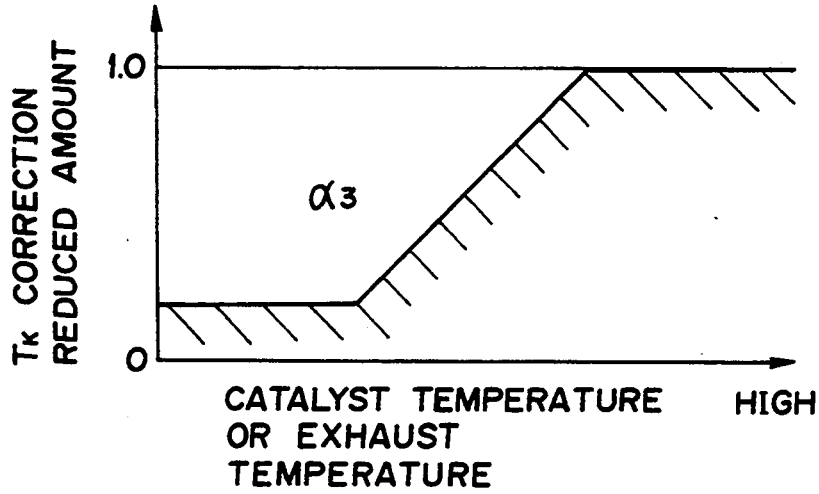
FIG. 42 is a view showing the relation between temperature of the catalytic member, etc., and a reduced amount of correction of $T_K$.
Figure 45:
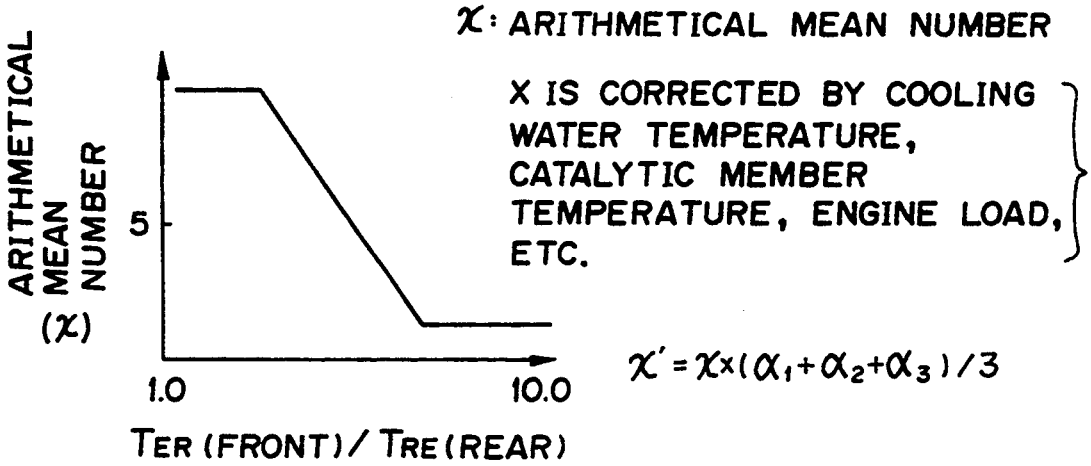
FIG. 45 is a view showing the relation between a deteriorated state of the catalytic member and an arithmetical mean number.

In FIG. 39, the predetermined time $T_K$ is changed depending on the deteriorating condition of the catalytic member 540, and the predetermined time $T_K$ in FIG. 36 is corrected by means of correcting reduction in quantity shown in FIGS. 40 to 42. That is, the predetermined time $T_K$ is calculated from the expression $T_K = T_K \times (\alpha_1 \alpha^2 + \alpha_3)/3$, and the integral amount (integral correction) ($I_{RL}$) is effected with the value shown in FIG. 43 (Step 806).

More specifically, in FIG. 40, the correcting reduced quantity ($\alpha_1$) of the predetermined time $T_K$ is determined depending on the cooling water temperature. In FIG. 41, the correcting reduced quantity ($\alpha_2$) of the predetermined time $T_K$ is determined depending on the engine load. In FIG. 42, the correcting reduced quantity ($\alpha_3$) of the predetermined time $T_K$ is determined depending on the catalyst temperature or exhaust temperature. By this, the predetermined time $T_K$ as the integral correction judging time is corrected depending on the deterioration of the catalyst and the cooling water temperature, engine load, temperature of the catalyst 540 or exhaust temperature, etc. of FIGS. 39 to 42 is corrected. The integral correction quantity ($I_{RL}$) is corrected depending on deterioration of the catalytic member 540 as shown in FIG. 43.

As shown in FIG. 44, in the second feedback control, the average (SOXFBAV) is calculated at every skip, i.e., the expression SOXFBAV=A+B/2 is calculated (Step 808).

From this average (SOXFBAV), the learned value (SOXFLAV), which has learned the second feedback control, is calculated as shown by the expression (1) of FIG. 44. This learned value (SOXFLAV), as shown in FIG. 45 and FIGS. 40 to 42, changes the arithmetical mean number (X) depending on deterioration of the catalytic member 540, etc. (Step 810). That is, this arithmetical mean number (X) is corrected depending on deterioration of the catalytic member 540 as in the predetermined time $T_K$.

Figure 46:
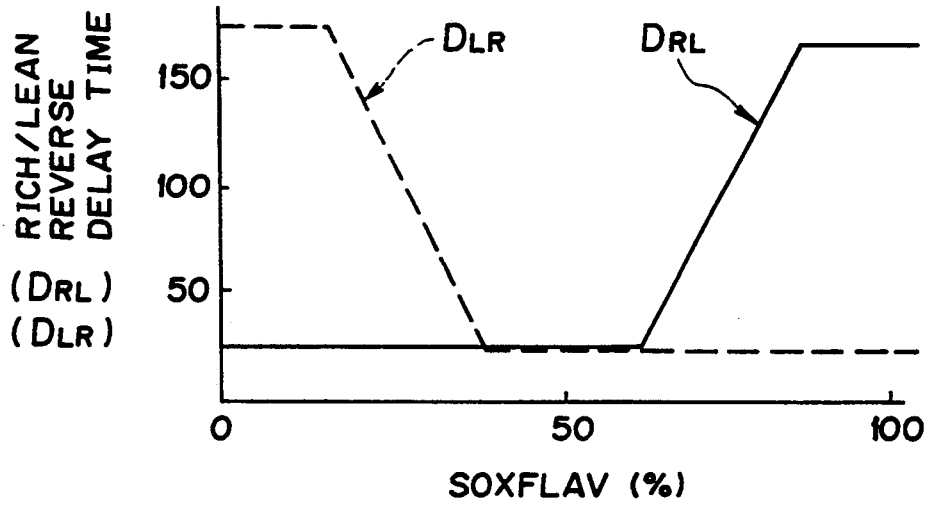
FIG. 46 is a view showing the relation between a learned value and a rich/lean reverse delay time.

Next, the first feedback control according to the first detection signal from the front $O_2$ sensor 538 is controlled as shown in FIG. 37 depending on the learned value (SOXFLAV) of the second feedback control shown in FIG. 46 (Step 812).

In this FIG. 46, the lean-rich reverse delay time ($D_{LR}$) is shown by broken lines, while the rich-lean reverse delay time ($D_{RL}$) is shown by a solid line.

And this control is repeated (Step 814).

If the judgment result in Step 706 is "NO", the open control is effected in accordance with the second detection signal from the rear $O_2$ sensor 544. In this open control, the second feedback control effecting area according to the second detection signal from the rear $O_2$ sensor 544 is determined in FIG. 34 with reference to the engine speed, intake pipe pressure, intake air quantity, fuel injection quantity, etc. (Step 902).

And it is judged whether or not it is the effecting area of the second feedback control (Step 904).

If the judgment result in Step 904 is "YES", the first feedback correction by the front $O_2$ sensor 538 is effected, as shown in FIG. 46, in accordance with each learned value (SOXFLAV) of the second feedback control of FIG. 34 (Step 906). This learned value (SOXFLAU) is calculated in FIGS. 44 and 45, and stored in each area of FIG. 34.

After this correction is effected, the program returns to Step 706 of FIG. 30.

Figure 32:
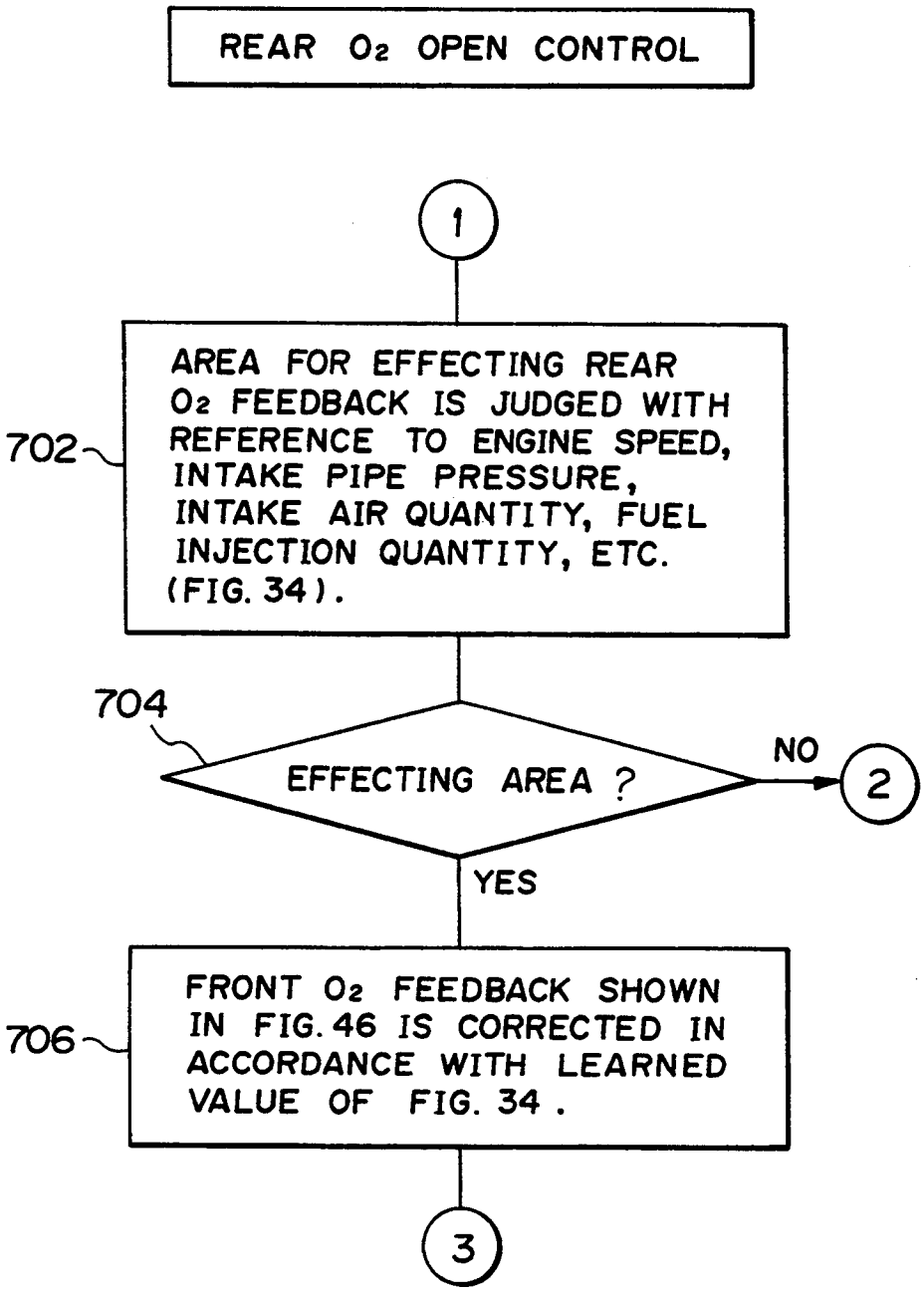
FIG. 32 is a flow chart of open control by the rear $O_2$ sensor.
Figure 33:
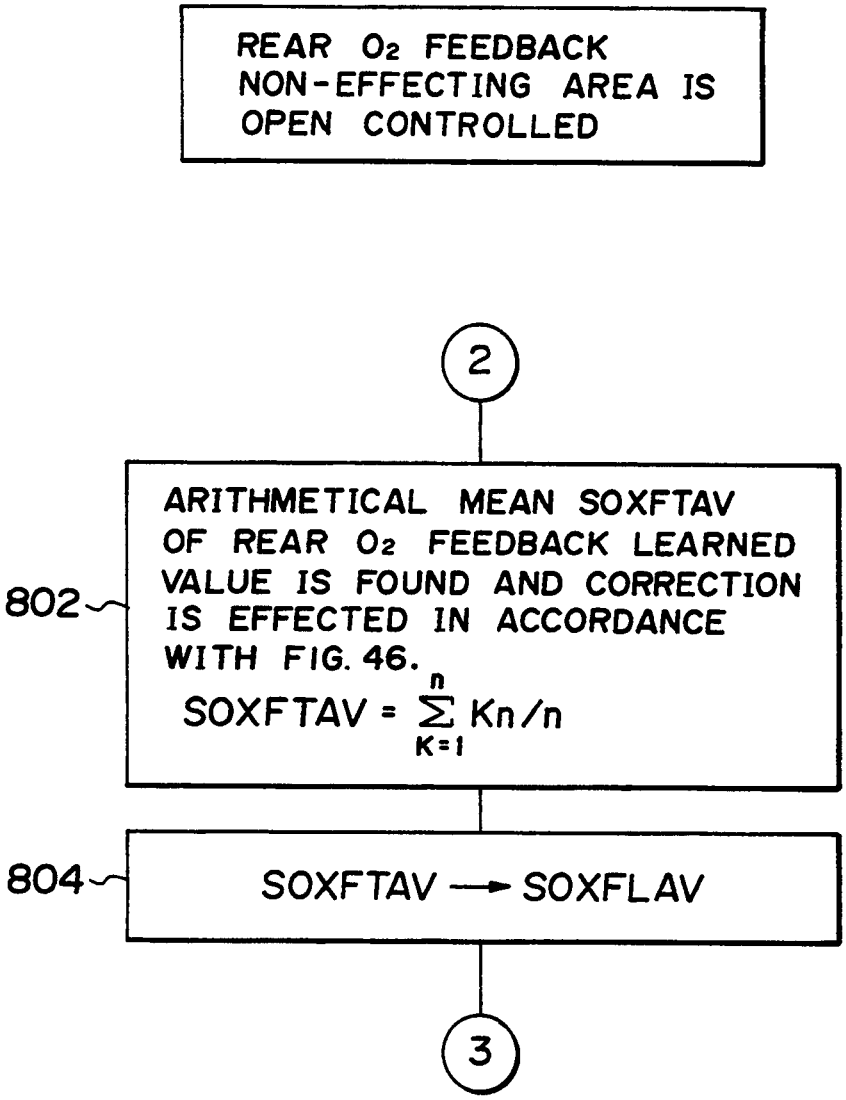
FIG. 33 is a flow chart of open control in an area where the second feedback control is not effected by the rear $O_2$ sensor.

If the judgment result in Step 710 of FIG. 30 is "NO" and if the judgment result in Step 904 of FIG. 32 is also "NO", the second feedback control non-effecting area (N) in accordance with the second detection signal from the rear $O_2$ sensor 544 is open controlled. In this open control, the arithmetical mean (SOXFTAV) of the learned value (SOXFLAU) stored in FIG. 34 is calculated by the second feedback control in accordance with the second detection signal from the rear $O_2$ sensor 544, and the correction is effected in accordance with FIG. 46 (Step 952 ).

Then, the arithmetical mean (SOXFTAV) is made into SOXFTAV→SOXFLAV (Step 954), and thereafter the program returns to Step 706 of FIG. 30.

Figure 47:
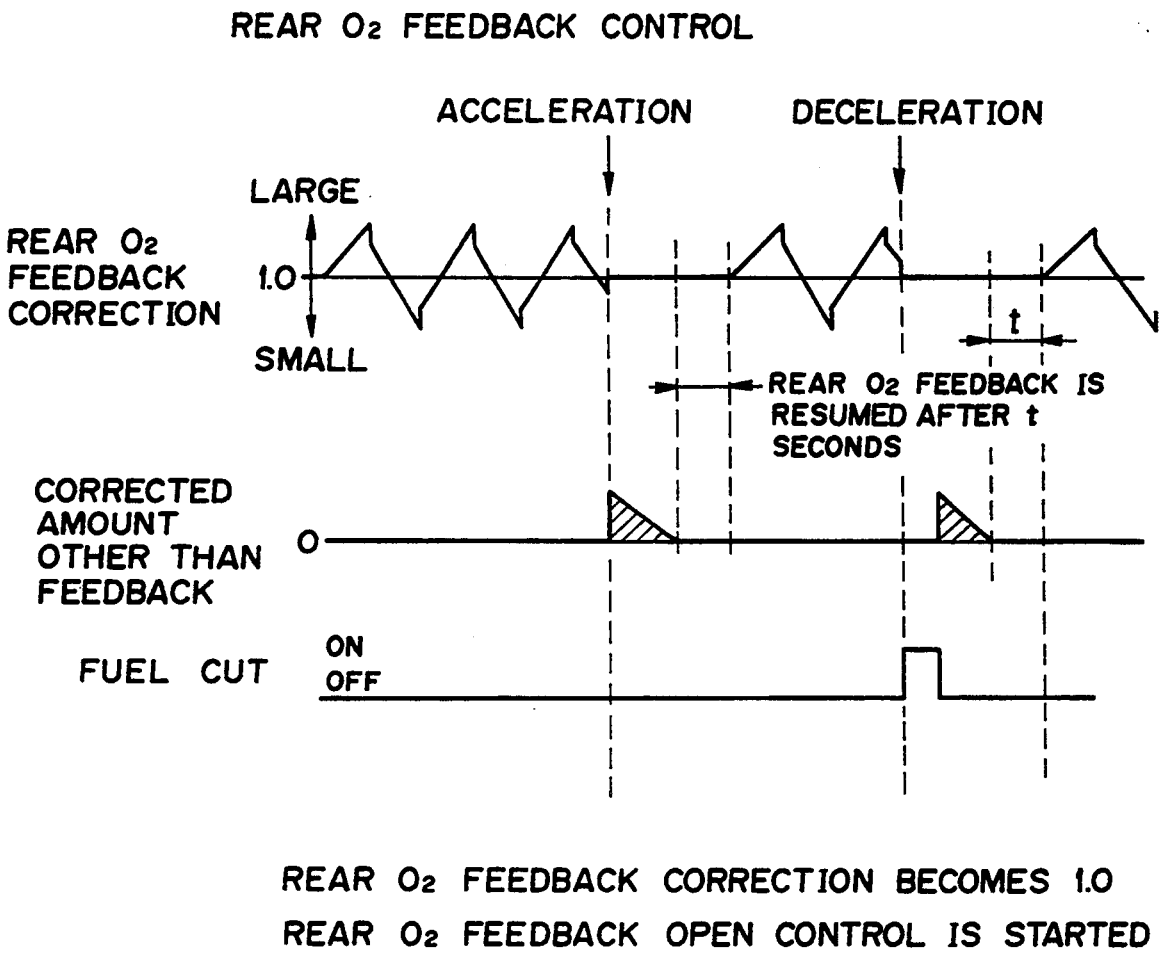
FIG. 47 is a time chart for slightly delaying the second feedback control from the start of the first feedback control under the feedback control in accordance with the rear $O_2$ sensor.

As shown in FIG. 47, the second feedback control is not started ($t_2$) after the passage of a few seconds (tsec) where the correction quantity other than the feedback control from the start ($t_1$) of the first feedback control shifted from the open control becomes none when the internal combustion engine 502 is accelerated and decelerated. At this time, the first feedback control state is corrected in accordance with FIG. 46 based on each learned value (SOXFLAV) stored in FIG. 34 during a period from the start of the first feedback control until the start of the second feedback control.

In FIG. 34, the area is divided into the effecting area (K) and the non-effecting area (N), and in this non-effecting area, the first feedback control state is corrected in accordance with FIG. 46 based on the average (SOXFTAV) of the learned value.

As a result, when other corrections than the feedback control occur because of unstable factors such as acceleration and deceleration of the internal combustion engine 502, i.e. accelerating and decelerating mode, etc. as shown in FIG. 47, the second feedback control is stopped to effect the open control, and the first feedback control is kept stable, and the air-fuel ratio in the steady driving mode is stably maintained to the logical air-fuel ratio, thereby to reduce generation of harmful exhaust component. Furthermore, during the period from the start of the first feedback control until the start of the second feedback control, since the first feedback control state is corrected based on the learned value of the second feedback control, the air-fuel ratio at the steady driving mode can be accurately controlled to the logical air-fuel ratio in order to reduce the generation of the exhaust harmful component. Moreover, as shown in FIG. 48, effect of the second feedback control can be enhanced.

Although a particular preferred embodiment of the invention has been disclosed in detail for illustrative purposes, it will be recognized that variations or modifications of the disclosed apparatus, including the rearrangement of parts, lie within the scope of the present invention.

ATTACHMENT A

In a conventional air-fuel ratio control device for an internal combustion engine, a front exhaust sensor and a rear exhaust sensor are disposed at exhaust passages on an upstream side and a downstream side of a catalyst converter, respectively.

As shown in FIG. 3, if a rich duration time for the rear exhaust sensor is $T_R$ and a lean duration time is $T_L$, the rich duration time $T_R$ and lean duration time $T_L$ are judged each integral value judging time $t_k$ in a predetermined rear side feedback control, and an integral value $I_{RL}$ in the rear side feedback control is determined by $T_R/T_L$.

The skipping amount, as shown in FIG. 6, is determined at each reverse action of rich/lean of the rear exhaust sensor, and two kinds of skipping amounts $S_{LR}$, $S_{RL}$ are used.

Rich/lean reverse delay time $D_{LR}$, $D_{RL}$ in feedback control of the front exhaust sensor is feedback-controlled by a rear feedback value SOXFB (%) (see FIG. 7).

When the catalyst converter is deteriorated, the output state of the rear exhaust sensor shown in FIG. 3 is changed so as to become close to that output state of the rear exhaust sensor as shown in FIG. 4, which is then similar to the cycle of output of the front exhaust sensor as shown in FIG. 2.

As a result, in a new catalyst converter and in a deteriorated catalyst converter, the rich/lean duration time of the rear exhaust sensor are different, and therefore it becomes difficult to see the integral value judging time $t_k$. That is practically inconvenient.

If the integral value judging time $t_k$ is set to be long, the rich/lean duration time of the rear exhaust sensor becomes short with a deteriorated catalyst converter, and the integral value is not generated. Since it is acted merely by the skipping amount, an adverse effect is exerted on the exhaust gas.

Figure 8:
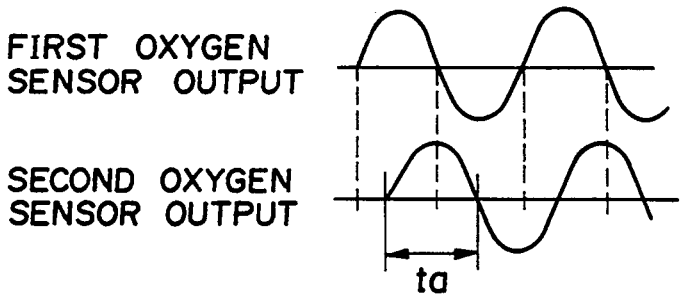
FIG. 8 PRIOR ART
FIG. 8 is a view showing the relation between a first detection signal of a first oxygen sensor and a second detection signal of a second oxygen sensor when a catalytic member is in a deteriorated condition, according to the prior art.

That is, in the case where the deteriorated catalyst converter is used, as shown in FIG. 9, if the integral value judging time $t_k$ is set to be long, it becomes impossible to judge whether it is a rich side or a lean side when $t_a$ shown in FIG. 8 is in the relation $t_k \geqq t_a$, and therefore, the integral value is not generated.

The rear feedback value SOXFB cannot be moved or changed because it is the integral value judging time, and activated only by the skipping amount in the neighborhood of the current value.

Therefore, the center of the feedback-control on the front side as an object of the feedback-control provided with the front exhaust sensor and the rear exhaust sensor, i.e., dual system feedback-control, cannot be controlled to $\alpha=1$. As a result, as shown in FIG. 10, the center of the feedback-control of the air-fuel ratio (A/F) is extensively shifted from $\alpha=1$ to generate a waviness.

Figure 10:
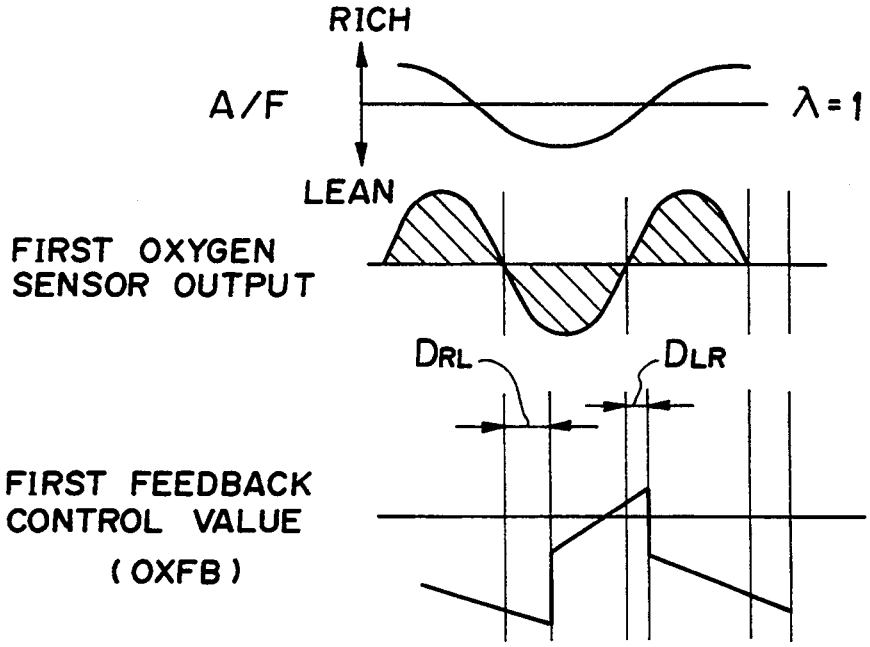
FIG. 10 PRIOR ART
FIG. 10 is a view showing a correlation among an air-fuel ratio, a first detection signal of a first oxygen sensor, and a first feedback control value (OXFB) when a catalytic member is in a deteriorated condition, according to the prior art.
Figure 11:
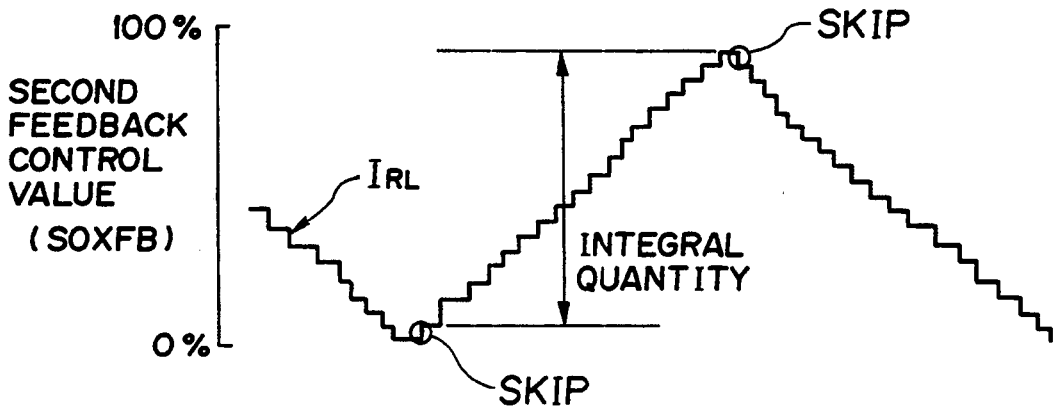
FIG.11 PRIOR ART
FIG. 11 is a view showing a conventional second feedback control value (SOXFB), according to the prior art.

This waviness, as also shown in FIG. 10, occurs when the rich/lean reverse delay times $D_{LR}$, $D_{RL}$, which are varied in accordance with the rear feedback value SOXFB, become long or short. $\alpha=1$ is a theoretical air-fuel ratio state.

If the integral value judging time $t_k$ is set to be short, the rich/lean duration time becomes long in the new catalyst converter. As a result, a large sway is generated to the rear side feedback control, and the ratio of the rich/lean in the front side feedback-control is also swayed extensively due to this large sway. As a result, an adverse effect is exerted to the exhaust gas.

Figure 12:
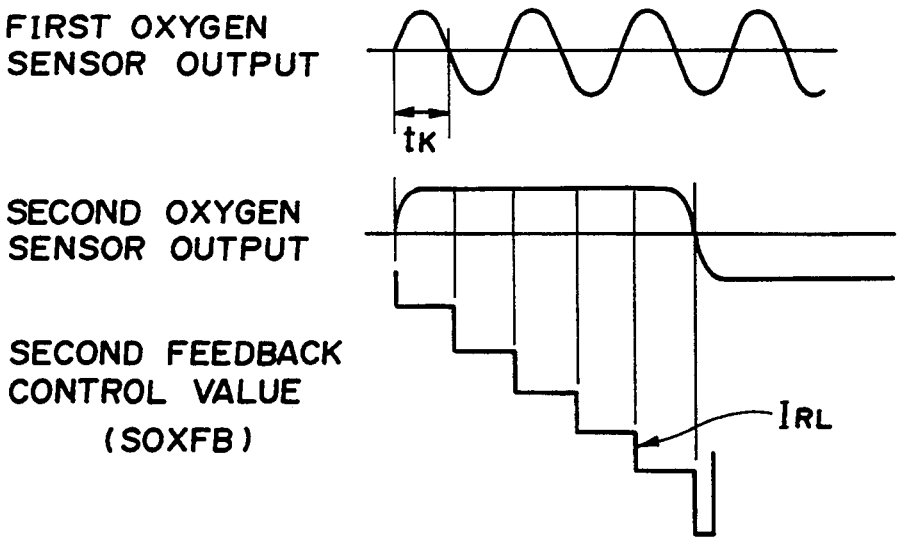
FIG.12 PRIOR ART
FIG. 12 is a view showing a correlation among a first detection signal, a second detection signal, and a second feedback control value (SOXFB), according to the prior art.

In other words, in the case of the new catalyst converter, the cyclic time of the rich/lean of the rear exhaust sensor becomes long, and the integral value $I_{RL}$ is frequently generated as shown in FIG. 12, and the rear feedback value SOXFB is extensively swayed.

Further, by feedback-controlling the rich/lean reverse delay time $D_{LR}$, $D_{RL}$ on the front side based on this rear feedback value SOXFB, the rich/lean reverse delay time $D_{LR}$, $D_{RL}$ becomes long or short, which makes it practically impossible to control the center of the feedback-control on the front side to $\alpha=1$ of the theoretical air-fuel ratio state. As a result, accuracy of the feedback-control becomes inferior and lowers the reliability, and an adverse effect is exerted to the exhaust gas.

The embodiments of the invention in which an exclusive property or privilege is claimed are defined as follows:

1. In an air-fuel ratio control device for an internal combustion engine comprising a first exhaust sensor disposed at an exhaust passage of the internal combustion engine on an upstream side of a catalytic member disposed at said exhaust passage, a second exhaust sensor disposed at said exhaust passage on a downstream side of said catalytic member, a first feedback control being effected such that an air-fuel ratio is brought into a target value with reference to a first feedback control value which is calculated with reference to a first detection signal outputted from said first exhaust sensor, a second feedback control being effected in order to correct said first feedback control value with reference to a second feedback control value which is calculated with reference to a second detection signal outputted from said second exhaust sensor, the improvement wherein:

said air-fuel ratio control device comprises control means for feedback-controlling the air-fuel ratio by changing a correction judging time and a correction amount of said second feedback control of said second exhaust sensor in accordance with an output cycle of said second detection signal from said second exhaust sensor and calculating a second feedback control learning value with reference to an arithmetical mean which is calculated with reference to a value just before a preceding skip and a value just before a current skip every time said second feedback control value is skipped, and an arithmetical mean number which is calculated in accordance with a cycle state of the, output of said second detection signal from said second exhaust sensor.

2. In an air-fuel ratio control device for an internal combustion engine having a first exhaust sensor disposed at an exhaust passage of the internal combustion engine on an upstream side of a catalytic member disposed at said exhaust passage, a second exhaust sensor disposed at said exhaust passage on a downstream side of said catalytic member, a first feedback control being effected such that an air-fuel ratio is brought into a target value with reference to a first feedback control value which is calculated with reference to a first detection signal outputted from said first exhaust sensor, a second feedback control being effected in order to correct said first feedback control value with reference to a second feedback control value which is calculated with reference to a second detection signal outputted from said second exhaust sensor, the improvement wherein said air-fuel ratio control device comprises control means for effecting a second feedback control such that an arithmetical mean is calculated with reference to a value just before a preceding skip and a value just before a current skip every time said second feedback control value is skipped, an arithmetical mean number being calculated based both on a cycle of said first detection signal and a cycle of said second detection signal in accordance with deterioration of said catalytic member, a learning value of the second feedback control of said second exhaust sensor being calculated with reference to said arithmetical mean and said arithmetical mean number in order to correct a reverse delay time of the air-fuel ratio of said first feedback control value with reference to said learning value of the second feedback control.

3. In an air-fuel ratio control device for an internal combustion engine comprising a catalyst converter disposed at an intermediate portion of an exhaust passage for the internal combustion engine, a front exhaust sensor disposed at said exhaust passage on an upper stream side of said catalyst converter, and a rear exhaust sensor disposed at said exhaust passage on a downstream side of said catalyst converter, an air-fuel ratio being feedback-controlled in accordance with detection signals from said front exhaust sensor and said rear exhaust sensor, the improvement wherein:

said air-fuel ratio control device comprising a control means in which when the air-fuel ratio is feedback-controlled, an integral value judging time for the feedback-control of said rear exhaust sensor is found based on a detection value indicating an output state of said front exhaust sensor and another detection value indicating an output state of said rear exhaust sensor which is changed in accordance with deterioration of said catalyst converter, and an integral amount is found, and the air-fuel ratio is feedback-controlled in accordance with the deterioration of said catalyst converter based on said integral value judging time and said integral amount.

4. In an air-fuel ratio control device for an internal combustion engine comprising a first exhaust sensor disposed at an exhaust passage of an internal combustion engine on an upstream side of a catalytic member which is disposed at an intermediate part of said exhaust passage, and a second exhaust sensor disposed at said exhaust passage on a downstream side of said catalytic member, the air-fuel ratio being first feedback controlled in a steady driving mode of said internal combustion engine in accordance with a first detection signal from said first exhaust sensor, the air-fuel ratio being open controlled in a mode other than said steady driving mode of said internal combustion engine, the air-fuel ratio being second feedback controlled in accordance with a second detection signal from said second exhaust sensor when conditions for effecting said second feedback control are met, said second feedback control being learned to calculate a learned value, the air-fuel ratio being open controlled when the condition is other than the conditions for effecting said second feedback control, said air-fuel ratio control device for an internal combustion engine being characterized by further comprising control means for stopping said second feedback control according to said second detection signal of said second exhaust sensor even if said conditions for effecting said second feedback control are met when the air-fuel ratio is open controlled in accordance with said first detection signal from said first exhaust sensor, and for correcting said first feedback controlling state based on the learned value of said second feedback control during a period from the start of said first feedback control in accordance with said first detection signal from said first exhaust sensor until the start of said second feedback control in accordance with said second detection signal from said second exhaust sensor.

* * * * *

UNITED STATES PATENT AND TRADEMARK OFFICE

CERTIFICATE OF CORRECTION

PATENT NO. : 5,337,557

DATED : August 16, 1994

INVENTOR(S) : Katsuhiko Toyoda

It is certified that error appears in the above-indentified patent and that said Letters Patent is hereby corrected as shown below:

Column 27, line 26; change "the, output" to
---the output---.

Signed and Sealed this

Twenty-ninth Day of November, 1994

*Attest:*

Bruce Lehman

BRUCE LEHMAN

*Attesting Officer*

*Commissioner of Patents and Trademarks*